US008814294B2

(12) United States Patent
Shibata

(10) Patent No.: US 8,814,294 B2
(45) Date of Patent: Aug. 26, 2014

(54) LIQUID SUPPLY DEVICE, LIQUID DISCHARGE DEVICE, AND IMAGE RECORDING APPARATUS HAVING PRESSURE BUFFERING UNIT

(75) Inventor: Hiroshi Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/613,616

(22) Filed: Sep. 13, 2012

(65) Prior Publication Data

US 2013/0076810 A1 Mar. 28, 2013

(30) Foreign Application Priority Data

Sep. 28, 2011 (JP) ..... P2011-212936

(51) Int. Cl.
*B41J 29/38* (2006.01)

(52) U.S. Cl.
USPC ..... 347/6; 347/17; 347/19

(58) Field of Classification Search
USPC ..... 347/6–7, 17, 19, 84–87
See application file for complete search history.

(56) References Cited

U.S. PATENT DOCUMENTS

| | | | | |
|---|---|---|---|---|
| 7,992,981 | B2 * | 8/2011 | Yokouchi | 347/85 |
| 2008/0198207 | A1 | 8/2008 | Katada | |
| 2009/0244131 | A1 | 10/2009 | Shibata | |
| 2010/0079514 | A1 | 4/2010 | Shibata | |
| 2010/0079562 | A1 | 4/2010 | Katada | |
| 2010/0220127 | A1 * | 9/2010 | Levy et al. | 347/6 |
| 2010/0245465 | A1 | 9/2010 | Nakamura et al. | |
| 2010/0245495 | A1 | 9/2010 | Katada | |
| 2012/0012206 | A1 * | 1/2012 | Watanabe et al. | 137/561 R |

FOREIGN PATENT DOCUMENTS

| | | | |
|---|---|---|---|
| EP | 2 361 773 | A2 | 8/2001 |
| EP | 1 584 478 | A2 | 10/2005 |
| EP | 2 105 306 | A2 | 9/2009 |
| JP | 2007-21996 | A | 2/2007 |
| JP | 2009-101516 | A | 5/2009 |
| JP | 2010-82823 | A | 4/2010 |
| JP | 2010-82988 | A | 4/2010 |
| WO | WO 2010/101124 | A1 | 10/2010 |

OTHER PUBLICATIONS

Extended European Search Report, issued Nov. 16, 2012 in European Patent Application No. 12184117.5.
Japanese Office Action and English translation thereof, dated Aug. 22, 2013, for Patent Application No. 2011-212936.

* cited by examiner

*Primary Examiner* — Juanita D Jackson
(74) *Attorney, Agent, or Firm* — Birch, Stewart, Kolasch & Birch, LLP

(57) ABSTRACT

A pressure buffering unit is reduced in size, and thereby the effect of a flexible membrane is suppressed while the performance of the pressure buffering unit is maintained. A liquid supply device includes: a liquid supply passage which communicates with a recording head in which a plurality of nozzles are arranged; a liquid pressure applying part provided in the liquid supply passage that applies a predetermined pressure to liquid; and a pressure buffering unit provided en route in the liquid supply passage and being configured to include a liquid chamber having a supply port and a discharge port through which the liquid flowing through the liquid supply passage flows in and out, a gas chamber provided to oppose the liquid chamber, and a flexible membrane interposed therebetween, wherein the flexible membrane is provided with initial bending in advance.

11 Claims, 30 Drawing Sheets

(FIG. 20 Continued)
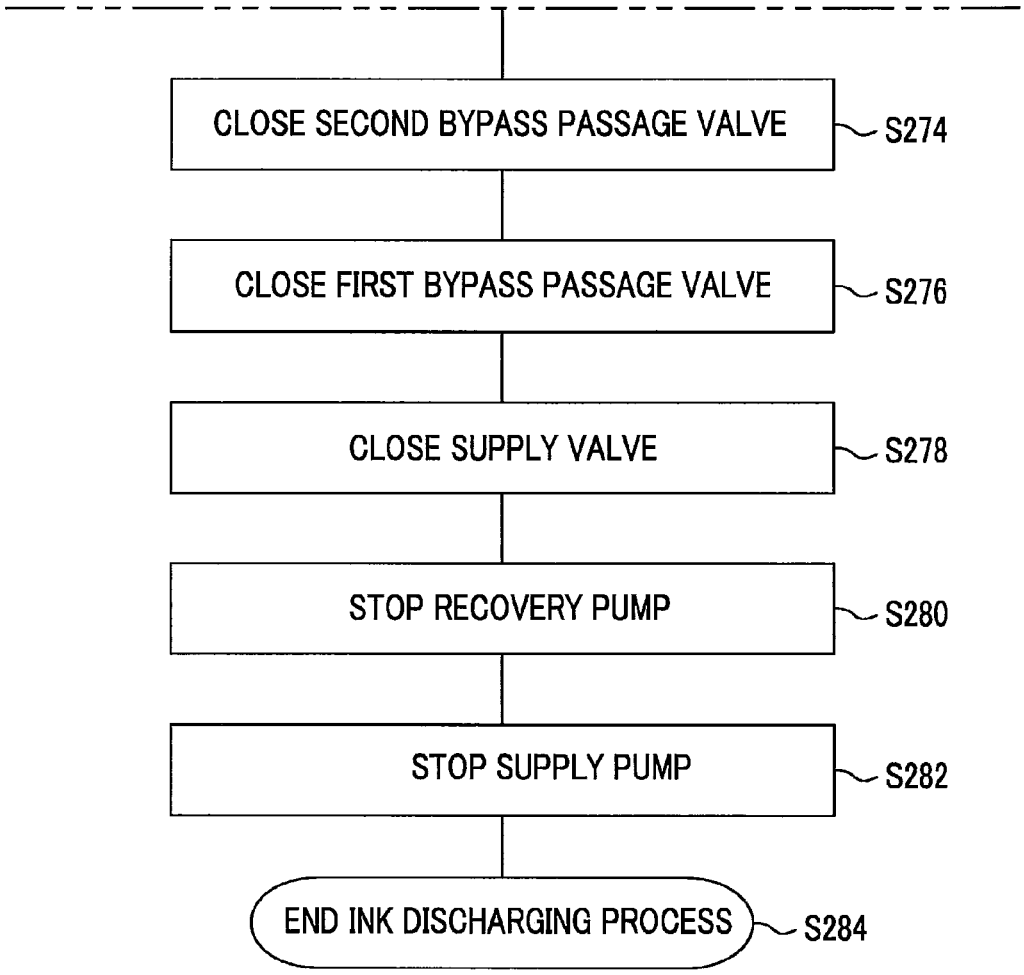

(FIG. 25 Continued)
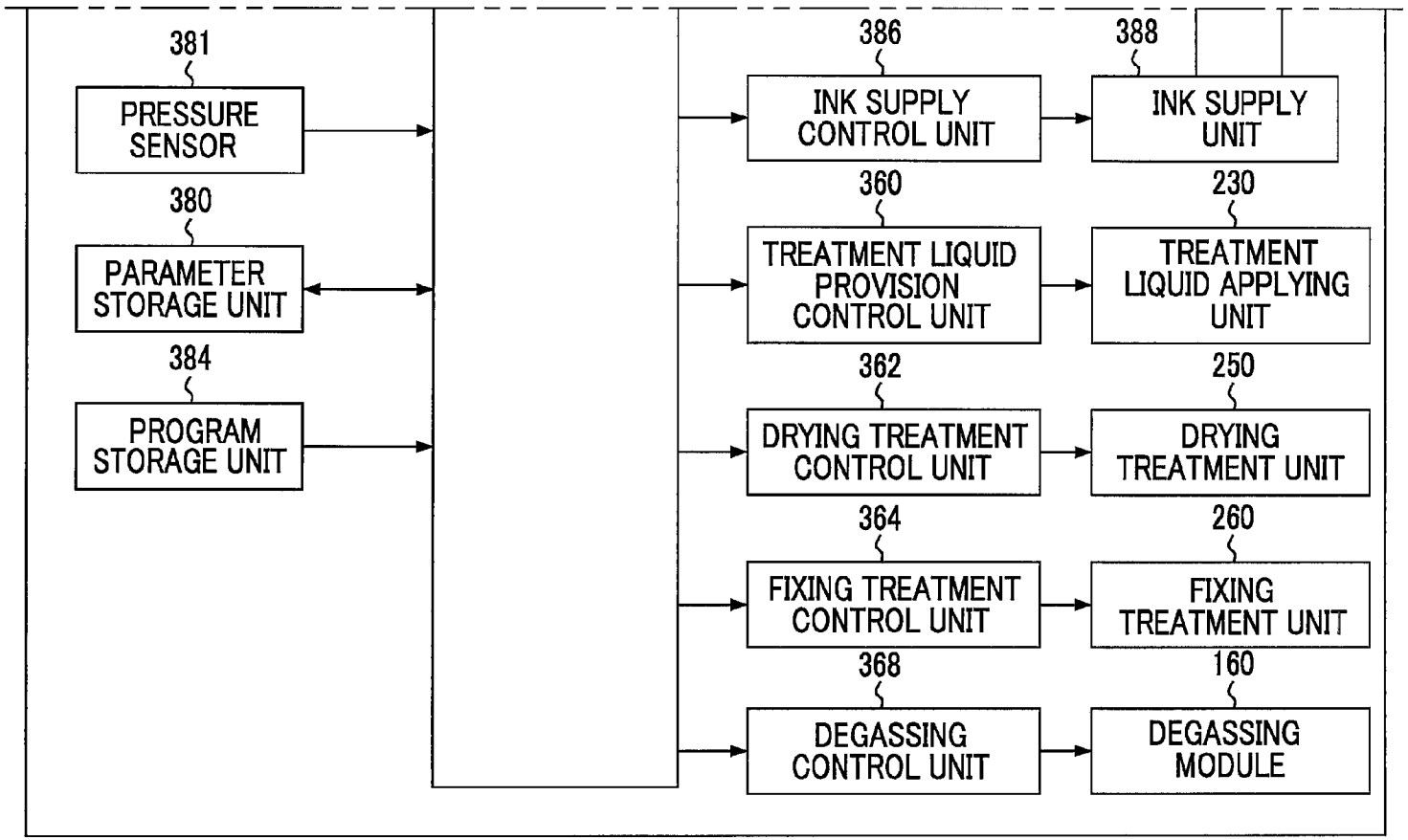

LIQUID SUPPLY DEVICE, LIQUID DISCHARGE DEVICE, AND IMAGE RECORDING APPARATUS HAVING PRESSURE BUFFERING UNIT

BACKGROUND OF THE INVENTION

1. Field of the Invention

The present invention relates to a liquid supply device, a liquid discharge device, and an image recording apparatus, and more particularly, to a pressure control technique for supplying a liquid to an ink jet head or the like.

2. Description of the Related Art

In order to stably operate an ink jet head and to stably supply an ink to the ink jet head, it is necessary that the internal pressure of the ink jet head or the pressure of an ink passage are controlled to be constant. As a means for controlling such pressure, a pump provided in the ink passage is used. On the other hand, when the internal pressure of the ink jet head or the pressure of the ink passage are controlled using the pump, a pressure change caused by the pulsatile flow of the pump may occur. The pressure change not also becomes an obstacle to stable ink supply but also disturbs the stable operation of the ink jet head.

On the other hand, a technique of providing a damper in an ink passage and suppressing a pressure change in the ink passage or a change in the internal pressure of an ink jet head is known. For example, a technique of varying the capacity of a sub-tank that communicates with the ink passage to function as a damper that suppresses the pressure change in the ink passage is known.

In JP2009-101516A, there is disclosed an inkjet recording apparatus including a recording head; first and second liquid chambers which communicate with the recording head; first and second communication passages which causes the first and second liquid chambers to communicate with a liquid buffer chamber, respectively; first and second pressure detecting means for detecting internal pressures of the first and second liquid chambers; a liquid moving means for causing a liquid to move between the first liquid chamber, the second liquid chamber, and the liquid buffer chamber; and pressure control means for controlling the liquid moving means so as to cause an inside of each of the first and second liquid chambers to become a predetermined pressure according to the detection results of the first and second pressure detecting means, and controlling the liquid moving means so that a predetermined pressure difference is set between the first liquid chamber and the second liquid chamber and a predetermined back pressure is applied to a liquid inside the nozzles of the recording head, thereby adjusting internal pressures of the first liquid chamber and the second liquid chamber, wherein two sub-tanks each of which has a liquid chamber and a gas chamber formed by dividing a sealed container by a flexible membrane are provided, and of the two sub-tanks, the liquid chamber of one sub-tank is the first liquid chamber and the other liquid chamber is the second liquid chamber.

According to JP2009-101516A, a pressure change caused by the movement of the liquid may be attenuated by the flexible membrane and the gas chamber. Accordingly, the pressure change is not transmitted to the recording head, and thus good printing quality may be ensured and pressure adjustment can be achieved with high accuracy.

SUMMARY OF THE INVENTION

A recording apparatus using a long head requires a supply of a large flow rate of liquid. In such a recording apparatus, a liquid buffer chamber serving as a pressure buffering unit needs to be increased in size. On the other hand, for a reduction of pressure losses, the liquid buffer chamber needs to be placed in the vicinity of the head and therefore requires a reduction in size. In addition, according to the liquid buffer chamber which is reduced in size, there caused are influences by a flexible membrane that divides a liquid chamber and a gas chamber. The characteristics of the membrane vary with thickness variations and/or aging variation, and thus there is a problem with pressure controllability.

The present invention has been made taking the foregoing circumstances into consideration, and an object thereof is to provide a liquid supply device, a liquid discharge device, and an image recording apparatus capable of reducing the size of a pressure buffering unit and thereby suppressing the effect of a flexible membrane and maintaining the performance of the pressure buffering unit.

In order to accomplish the object, according to a first aspect, a liquid supply device includes: a liquid supply passage which communicates with a recording head; a liquid pressure applying part provided in the liquid supply passage that applies a pressure to liquid; and a pressure buffering unit provided en route in the liquid supply passage and being configured to include a liquid chamber having a supply port and a discharge port through which the liquid flowing through the liquid supply passage flows in and out, a gas chamber provided to oppose the liquid chamber, and a flexible membrane interposed between the liquid chamber and the gas chamber, wherein the flexible membrane is provided with initial bending in advance.

According to this aspect, since the flexible membrane of the pressure buffering unit is provided with initial bending in advance, the effect of the flexible membrane is suppressed and thus the size of the pressure buffering unit may be reduced while maintaining the performance of the pressure buffering unit.

The flexible membrane may have a three-dimensional shape that follows a shape of an inner wall of the gas chamber. Accordingly, a burden on the flexible membrane is reduced and thus the life span of the flexible membrane may be increased. In addition, the "three-dimensional shape that follows the shape of the inner wall of the gas chamber" mentioned here indicates a shape which is arranged to follow the shape of the inner wall of the gas chamber to correspond to the shape of the inner wall of the gas chamber.

In this case, it is preferable that an air communication passage switching part that switches between opening and blocking of the gas chamber to and from an air be provided and the initial bending be provided by changing a bending amount of the flexible membrane by the liquid pressure applying part in a state where the gas chamber is open to the air, and by blocking the gas chamber from the air when the bending amount becomes a desired bending amount. Accordingly, appropriate initial bending may be applied to the flexible membrane having the three-dimensional shape.

In addition, it is preferable that the inner wall of the gas chamber have a curved surface. Accordingly, even when the flexible membrane deforms and comes into contact with the inner wall of the gas chamber, the flexible membrane is not damaged and the durability of the flexible membrane may be ensured.

Moreover, it is preferable that a pressure detecting part that detects a pressure in the liquid chamber, and a control part that controls driving of the liquid pressure applying part based on a detection result of the pressure detecting part, thereby applying a predetermined back pressure to a nozzle arranged in the recording head, be included. Accordingly, the liquid may be supplied by causing the back pressure of the nozzles of the recording head to be an appropriate value.

In order to accomplish the object, according to another aspect, a liquid supply device includes: a liquid supply passage which communicates with a recording head; a first liquid pressure applying part provided in the liquid supply passage that applies a pressure to liquid; a first pressure buffering unit provided en route in the liquid supply passage and being configured to include a first liquid chamber having a supply port and a discharge port through which the liquid flowing through the liquid supply passage flows in and out, a first gas chamber provided to oppose the first liquid chamber, and a first flexible membrane interposed between the first liquid chamber and the first gas chamber; a liquid recovery passage which communicates with the recording head; a second liquid pressure applying part provided in the liquid recovery passage that applies a pressure to the liquid; and a second pressure buffering unit provided en route in the liquid recovery passage and being configured to include a second liquid chamber having a supply port and a discharge port through which the liquid flowing through the liquid recovery passage flows in and out, a second gas chamber provided to oppose the second liquid chamber, and a second flexible membrane interposed between the second liquid chamber and the second gas chamber, wherein the first flexible membrane and the second flexible membrane are provided with initial bending in advance.

According to this aspect, since the flexible membrane of the first pressure buffering unit and the flexible membrane of the second pressure buffering unit are provided with initial bending in advance, the sizes of the first pressure buffering unit and the second pressure buffering unit may be reduced while maintaining the performance of the first pressure buffering unit and the second pressure buffering unit.

The first flexible membrane and the second flexible membrane may have three-dimensional shapes that follow shapes of inner walls of the first gas chamber and the second gas chamber, respectively. Accordingly, a burden on the flexible membrane is reduced and thus the life span of the flexible membrane may be increased.

In this case, it is preferable that a first air communication passage switching part that switches between opening and blocking of the first gas chamber to and from an air; and a second air communication passage switching part that switches between opening and blocking of the second gas chamber to and from an air be included, the initial bending be provided to the first membrane by changing a bending amount of the first flexible membrane by the first liquid pressure applying part in a state where the first gas chamber is open to the air, and by blocking the first gas chamber from the air when the bending amount becomes a desired bending amount, and the initial bending be provided to the second membrane by changing a bending amount of the second flexible membrane by the second liquid pressure applying part in a state where the second gas chamber is open to the air, and by blocking the second gas chamber from the air when the bending amount becomes a desired bending amount. Accordingly, initial bending may be appropriately provided to the flexible membrane having the three-dimensional shape.

In addition, it is preferable that the inner wall of the first gas chamber and the inner wall of the second gas chamber have curved surfaces. Accordingly, even when the flexible membrane deforms and comes into contact with the inner wall of the gas chamber, the flexible membrane is not damaged and the durability of the flexible membrane may be ensured.

Moreover, it is preferable that a first pressure detecting part that detects a pressure in the first liquid chamber; a second pressure detecting part that detects a pressure in the second liquid chamber; and a control part that controls driving of the first liquid pressure applying part and the second liquid pressure applying part based on detection results of the first pressure detecting part and the second pressure detecting part, thereby providing a predetermined pressure difference between the pressure in the first liquid chamber and the pressure in the second liquid chamber and applying a predetermined back pressure to a nozzle arranged in the recording head be included. Accordingly, the liquid may be supplied and recovered by causing the back pressure of the nozzles of the recording head to be an appropriate value.

In order to accomplish the object, according to still another aspect, a liquid discharge device includes: the liquid supply device of the above aspect; a recording head which discharges liquid from a nozzle; and a liquid storage unit which communicates with the liquid supply passage and stores the liquid discharged from the nozzle.

As such, the liquid supply device of the above aspect may be applied to the liquid discharge device.

In order to accomplish the object, according to still another aspect, an image recording apparatus includes: the liquid discharge device of the above aspect; and a scanning part that relatively moves the recording head and a recording medium with each other.

As such, the liquid discharge device of the above aspect may be applied to the image recording apparatus.

According to the present invention, the size of the pressure buffering unit may be reduced while maintaining the performance of the pressure buffering unit.

DESCRIPTION OF THE PREFERRED EMBODIMENTS

Hereinafter, exemplary embodiments of the present invention will be described in detail with reference to the accompanying drawings.

First Embodiment

Entire Configuration of Non-circulation Type Ink Supply Device

Figure 1:
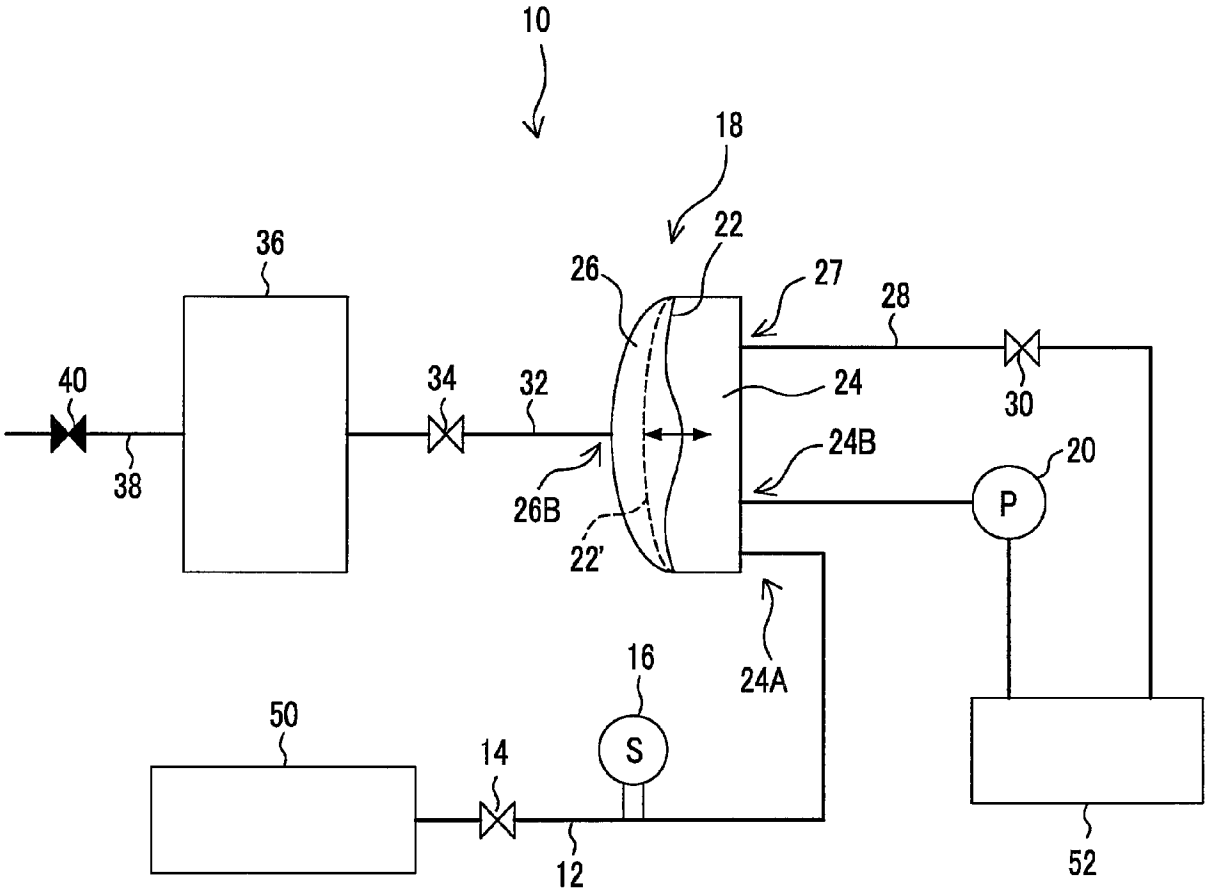
FIG. 1 is a block diagram illustrating the schematic configuration of a non-circulation type ink supply device according to a first embodiment.

FIG. 1 is a block diagram illustrating the entire configuration of an ink supply device according to a first embodiment of the present invention. The ink supply device 10 illustrated in FIG. 1 is a non-circulation type ink supply device that supplies ink to an ink jet head (hereinafter, simply referred to as "head") 50, which is a liquid supply object from an ink tank 52, and controls the internal pressure (back pressure) of the head 50 in accordance with the amount of ink sent thereto.

As illustrated in FIG. 1, the ink supply device 10 includes a supply passage 12 as a liquid supply passage that communicates with the head 50 and a supply valve 14 that switches between communication and non-communication between the head 50 and the supply passage 12. The ink supply device 10 further includes a pressure sensor 16 as a pressure detecting part that detects the internal pressure of the supply passage 12 and a supply sub-tank 18 that performs pressure adjustment in order to suppress variations in the internal pressure of the supply passage 12. The ink supply device 10 further includes a supply pump 20 as a liquid pressure applying part, which is connected to the opposite side of the supply sub tank 18 to the head 50 (connected to the supply passage 12 between the supply sub-tank 18 and the ink tank 52) and applies a pressure to the inside of the supply passage 12.

As for the supply valve 14, a normally open (or latch) electromagnetic valve of which opening and closing is controlled by a control signal is applied. The pressure sensor 16 converts the internal pressure of the supply passage 12 into an electrical signal so as to be output. As the pressure sensor 16, a sensor of a semiconductor piezoresistive type, capacitive type, silicon resonant type, or the like may be applied. When the supply pump 20 is operated to rotate forward as the supply valve 14 is opened, the ink flows into the supply passage 12 from the ink tank 52 and passes through the supply sub-tank 18, and the ink is sent to the head 50.

In addition, the ink supply device 10 has a pressure buffering unit which includes the supply sub-tank 18 and an air tank 36 configured to be able to communicate with a gas chamber 26 of the supply sub-tank 18.

The supply sub-tank 18 has a structure partitioned into a liquid chamber 24 and the gas chamber 26 by a flexible elastic membrane (flexible membrane) 22 having initial bending. An ink outflow port 24A of the liquid chamber 24 communicates with the head 50 via the supply passage 12 and the supply valve 14, and an ink inflow port 24B communicates with the ink tank 52 via the supply pump 20. Moreover, a bubble discharge port 27 of the liquid chamber 24 communicates with the ink tank 52 via a drain passage 28 and a drain valve 30.

When ink flows into the liquid chamber 24 from the ink inflow port 24B, the elastic membrane 22 deforms toward the gas chamber 26 according to the volume of the inflow ink. On the other hand, since the volume of the ink that flows out of the ink outflow port 24A does not change, even when a pressure change occurs in the supply passage 12, the pressure change is suppressed by the action of the supply sub-tank 18. That is, the supply sub-tank 18 has a pressure buffering function of suppressing a change in the internal pressure of the head 50 and a change in the internal pressure of the supply passage 12 due to a pulsatile flow caused by the operation of the supply pump 20.

The drain passage 28 communicates with the liquid chamber 24 via the bubble discharge port 27 and thus serves as a passage adapted to forcibly discharge the liquid in the liquid chamber 24. When the drain valve 30 is opened, the ink in the liquid chamber 24 is sent to the ink tank 52 via a predetermined passage.

The gas chamber 26 communicates with the air tank 36 via an air passage 32 and an air connection valve 34. The air tank 36 is configured to be able to communicate with the air via an air valve 40 as an air communication passage switching part provided in the air communication passage 28. That is, the gas chamber 26 may be caused to communicate with the air tank 36 by opening the air connection valve 34, and thus the volume of the gas chamber 26 may be increased in accordance with the pressure control of the sent ink. Moreover, by opening the air valve 40, the air tank 36 and the gas chamber 26 may be caused to communicate with the air.

The air tank 36 that functions as a buffer tank of the gas chamber 26 has a volume three times the maximum volume of the gas chamber 26. Here, the "maximum volume of the gas chamber 26" is the volume of the gas chamber 26 in a state where the elastic membrane 22 is positioned at an initial position (described later in detail). In addition, it is preferable that the volume of the gas chamber 26 be great in terms of the pressure buffering function. However, since the deformation amount of the elastic membrane 22 is limited, the volume of the gas chamber 26 is limited by the deformation amount of the elastic membrane 22.

In order to achieve both ensuring the pressure buffering function and not applying an excessive stress to the elastic membrane 22, the air tank 36 is provided in addition to the gas chamber 26. The air tank 36 may have a volume that is greater than the maximum volume of the gas chamber 26, and preferably, is greater than three times the maximum volume of the gas chamber 26. On the other hand, when the volume of the air tank 36 is too great, the responsiveness of the pressure control is degraded, and thus the total amount of the volume of the gas chamber 26 and the volume of the air tank 36 has an optimal value.

A normally open electromagnetic valve is applied as the air connection valve 34 and a normally closed electromagnetic valve is applied as the air valve 40 to achieve a configuration in which even though power is shut off in a case where an emergency stop function is operated and the like, ink does not leak from the head 50.

The face of the liquid chamber 24 on the opposite side to the elastic membrane 22 is provided with the bubble discharge port 27 for discharging bubbles collected in the liquid chamber 24 and communicates with the drain passage 28 (see FIG. 1) via the bubble discharge port 27. The bubble discharge port 27 is provided in the uppermost portion because bubbles are likely to escape from the upper portion, and the ink outflow port 24A is provided in the lowermost portion in which bubbles are less likely to flow so as not to cause bubbles to flow to the head.

In addition, in the wall that constitutes the opposing surface (illustrated by being denoted by reference numeral 26A in FIG. 2) of the gas chamber 26, an air passage communication port 26B that communicates with the air passage 32 (see FIG. 1) is provided.

Configuration of Supply Sub-Tank

Figure 2:
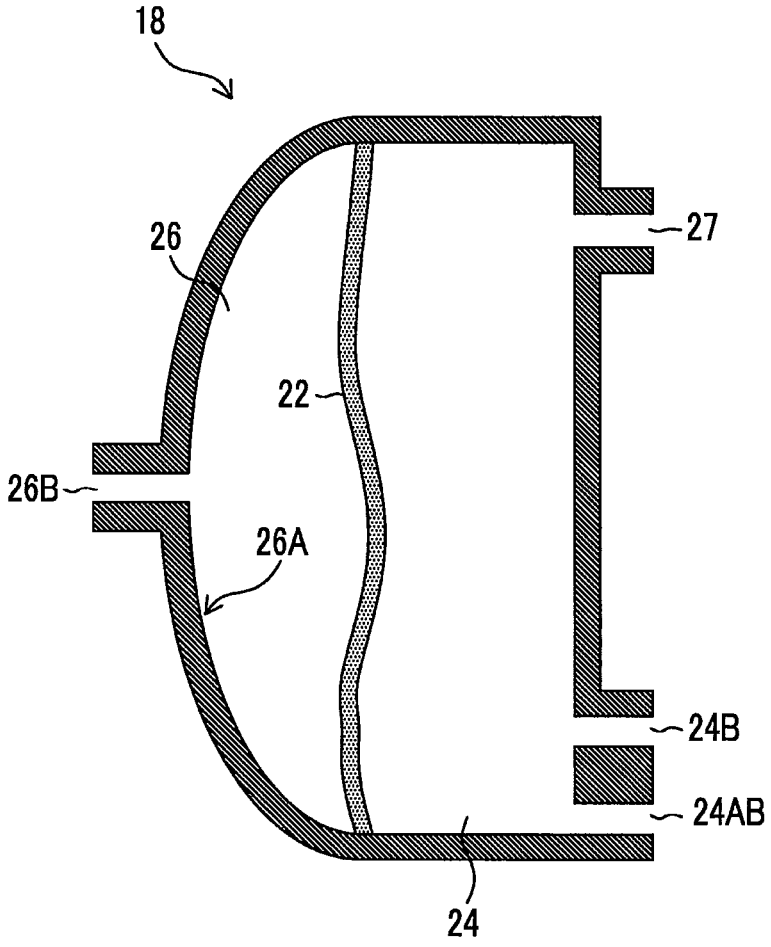
FIG. 2 is a cross-sectional view illustrating the structure of a sub-tank applied to the non-circulation type ink supply device illustrated in FIG. 1.

FIG. 2 is a cross-sectional view illustrating a structure example of the supply sub-tank 18. As shown in this figure, the supply sub-tank 18 is configured by a sealed container of which inside is divided by the elastic membrane 22. The one side of the elastic membrane 22 is referred to as the liquid chamber 24, and the other side is referred to as the gas chamber 26. When ink flows in from the ink inflow port 24B, the elastic membrane 22 deforms toward the gas chamber 26 so as to balance the pressure of the liquid chamber 24 (the amount of ink sent) and the pressure in the gas chamber 26. With this structure, the supply sub-tank 18 functions as damper when a pressure change occurs in the supply passage 12.

In addition, the gas chamber 26 of the supply sub-tank 18 has a bowl shape (dome shape) in which the surface (opposing surface) 26A of the inner wall that opposes the elastic membrane 22 is constituted by a curved surface. Accordingly, even when the elastic membrane 22 deforms and comes into contact with the opposing surface 26A, the elastic membrane 22 is prevented from touching the opposing surface at its corners and thus being damaged. Accordingly, the durability of the elastic membrane 22 is ensured.

Figure 3:
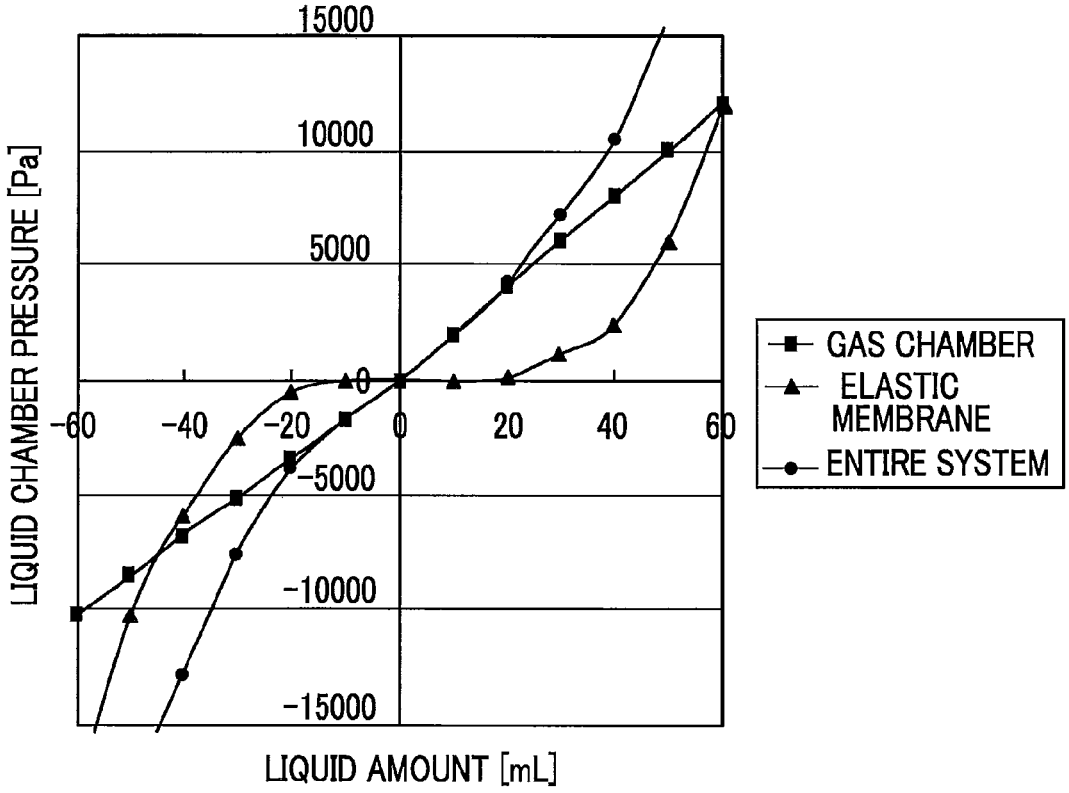
FIG. 3 is a graph showing the negative pressure characteristics of an elastic membrane, a gas chamber, and the entire system.

A change in the pressure of the supply sub-tank 18 due to the ink inflow amount is referred to as negative pressure characteristics. FIG. 3 is a graph showing the negative pressure characteristics of the elastic membrane 22, the gas chamber 26, and the entire system, where the volume of the gas chamber 26 is set to 700 mL, the size of the elastic membrane 22 (the size of the liquid chamber 24) is set to ϕ80 mm. In the graph, the amount of ink that flows into or is discharged from the liquid chamber 24 in a state where the liquid chamber 24 is sealed is plotted in the horizontal axis [unit: mL], and the pressures of the elastic membrane 22, the gas chamber 26 and the entire system are plotted in the vertical axis [unit: Pa]. For example, in the example of FIG. 1, by controlling the rotation direction of the supply pump 20 to forward and reverse directions in a state where the supply valve 14 and the drain valve 30 are closed, the ink may be caused to flow or be discharged into/from the liquid chamber 24. The ink amount in FIG. 3 is shown to be positive in the case where ink flows into the liquid chamber 24 and is shown to be negative in the case where ink is discharged from the liquid chamber 24.

As shown in this figure, regarding the negative pressure characteristics of the elastic membrane 22, a pressure change rarely exists in the loose region (the flat region of the elastic membrane curve of FIG. 3) of the elastic membrane 22 while the ink inflow amount (discharge amount) is small. However, when the ink inflow amount (discharge amount) is increased and thus the elastic membrane 22 protrudes, a pressure change rapidly occurs. The negative pressure characteristics of the elastic membrane 22 change depending on the type, the thickness, or the like of the membrane.

On the other hand, the negative pressure characteristics of the gas chamber 26 are determined to be uniform when the capacities of the gas chamber 26 and the air tank 36 are determined. Moreover, the negative pressure characteristics of the entire system are the sum of the negative pressure characteristics of the elastic membrane 22 and the negative pressure characteristics of the gas chamber 26 and the air tank 36. Therefore, the capacities of the gas chamber 26 and the air tank 36 may be determined in consideration of pressure control performance in the loose region of the elastic membrane 22. That is, the lower limit of the total amount of the capacities of the gas chamber 26 and the air tank 36 is determined from the stability of pressure control and pressure buffering characteristics, and the upper limit thereof is determined from the responsiveness of pressure control. Therefore, the total amount of the capacities of the gas chamber 26 and the air tank 36 has an optimal value. In addition, the lower limit of the capacity of the gas chamber 26 is determined by the initial bending amount of the elastic membrane 22, and the upper limit thereof is determined by the maximum deformation amount of the elastic membrane 22. Therefore, the capacity of the gas chamber has an optimal value.

Figure 4A:
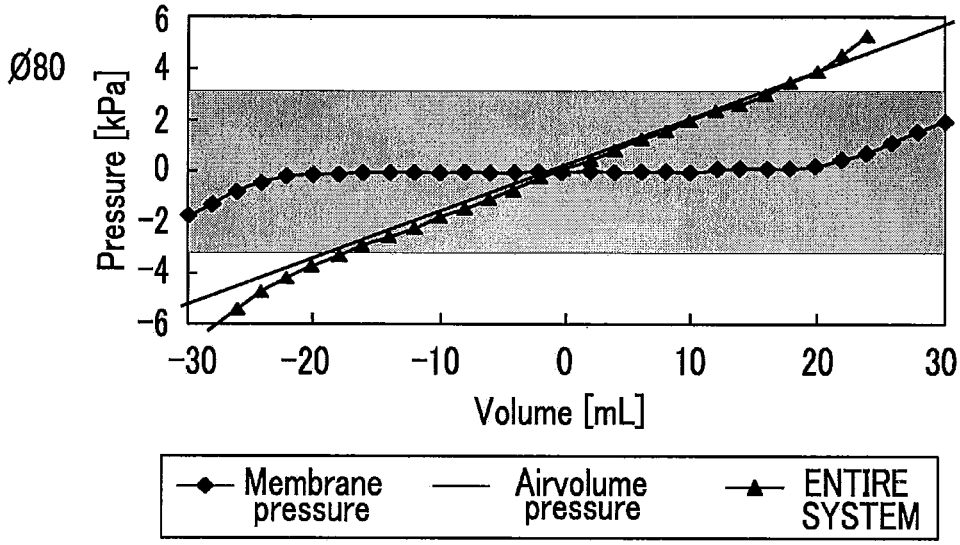
FIGS. 4A to 4D are graphs showing the negative pressure characteristics of the elastic membrane, the gas chamber, and the entire system in each size of the elastic membrane.
Figure 4B:
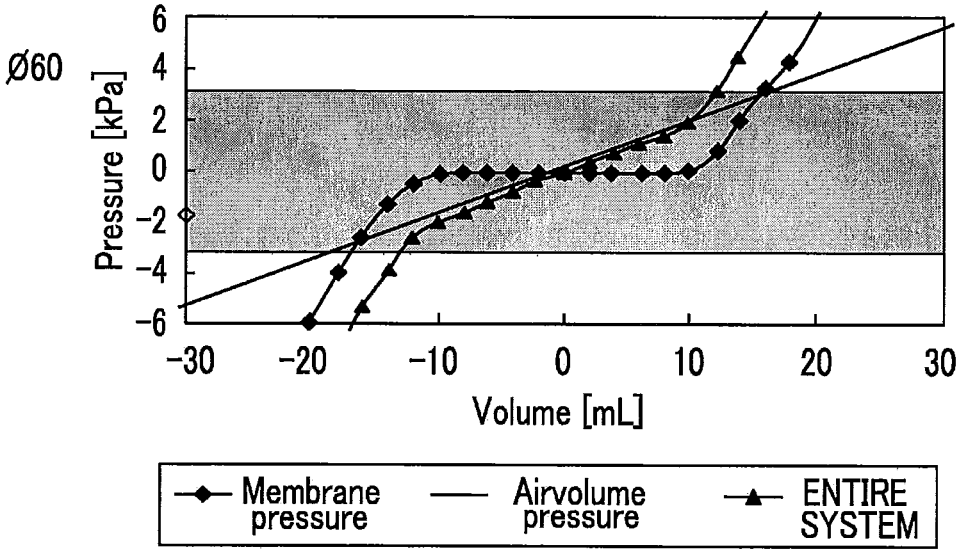
Figure 4C:
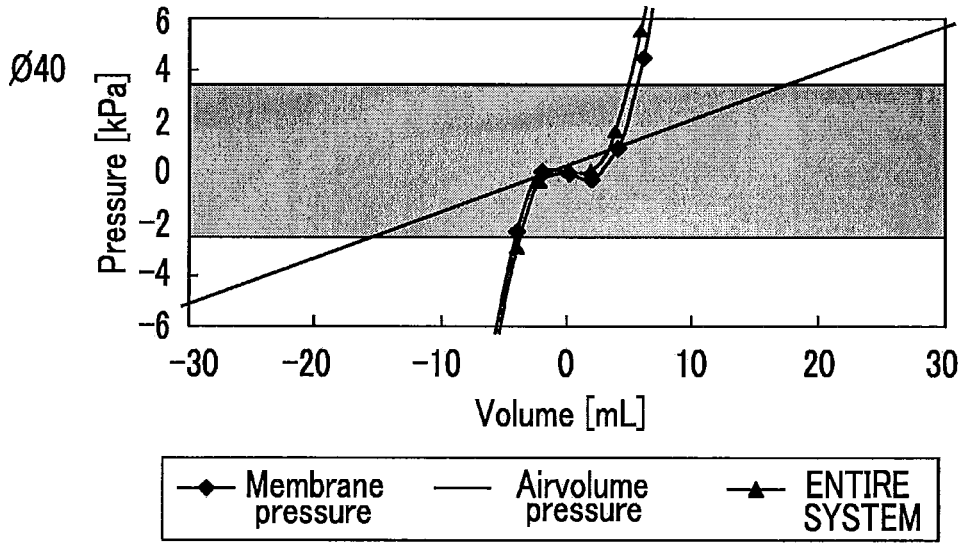
Figure 4D:
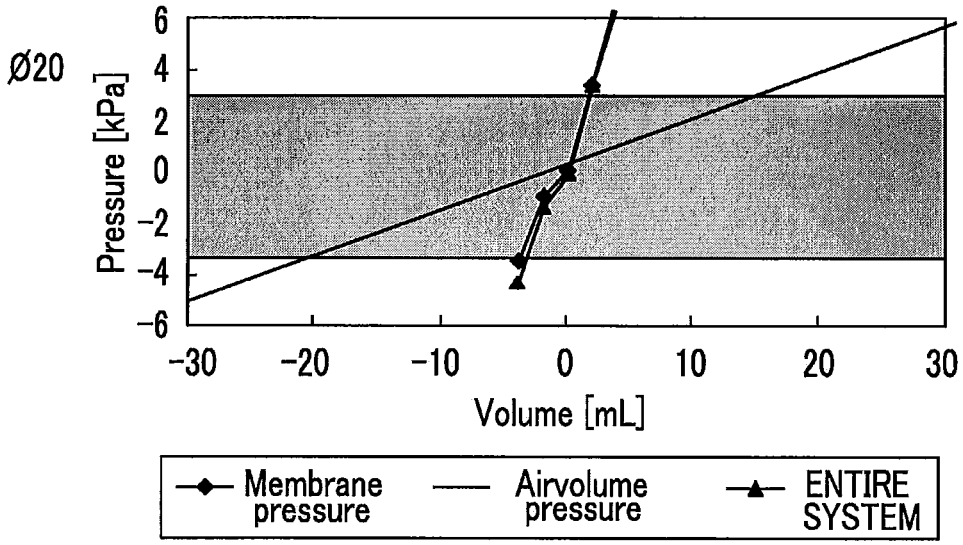

Here, in order to reduce pressure losses, it is preferable that the supply sub-tank 18 be disposed in the vicinity of the head 50 (see FIG. 1), and a reduction in the size of the liquid chamber 24 is required. FIGS. 4A to 4D are graphs showing the negative pressure characteristics of the elastic membrane 22, the gas chamber 26, and the entire system in each size of the elastic membrane 22. FIG. 4A shows a case of ϕ80 mm, FIG. 4B shows a case of ϕ60 mm, FIG. 4C shows a case of ϕ40 mm, and FIG. 4D shows a case of ϕ20 mm.

As shown in FIGS. 4A to 4D, when the size of the supply sub-tank 18 (liquid chamber 24) is reduced and thus the size of elastic membrane 22 is reduced, the loose region of the elastic membrane 22 is narrowed, and thus the effect of the elastic membrane 22 becomes dominant in a pressure control region (here, a range of ±3 kPa).

Figure 5A:
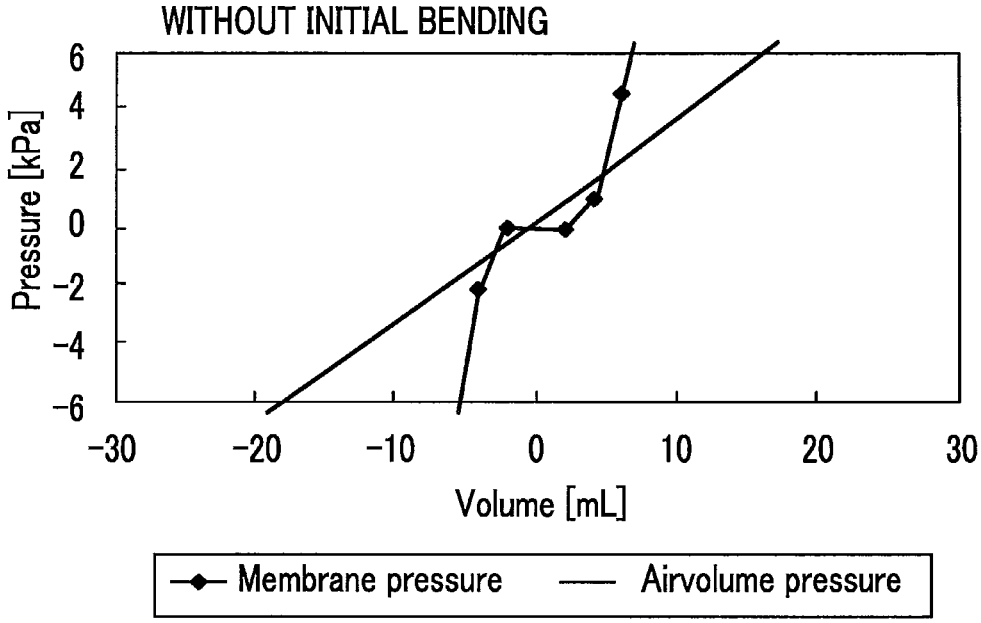
FIGS. 5A to 5C are graphs showing the negative pressure characteristics of the elastic membrane and the gas chamber at each bending amount of the elastic membrane.
Figure 5B:
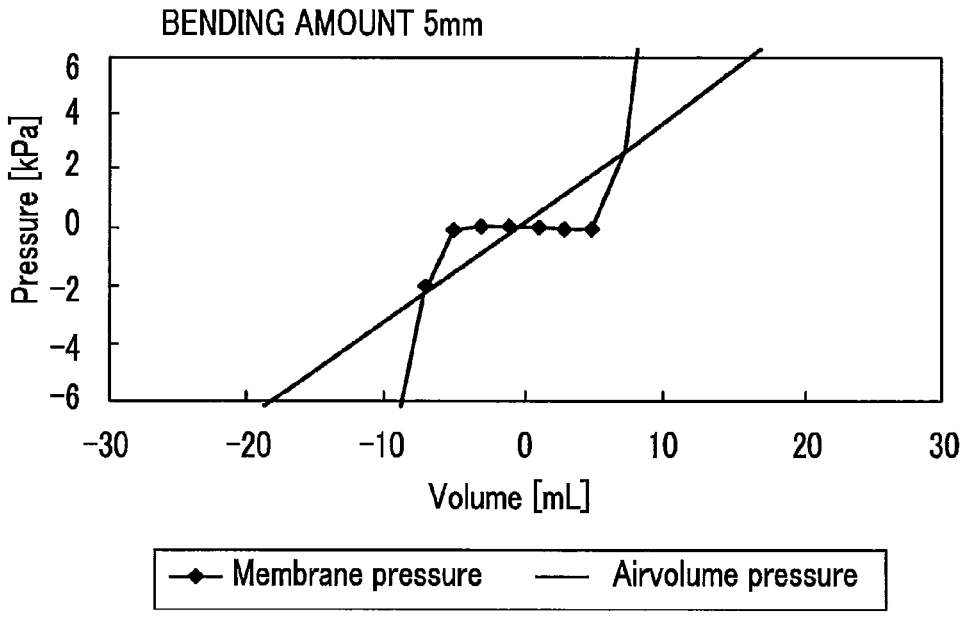
Figure 5C:
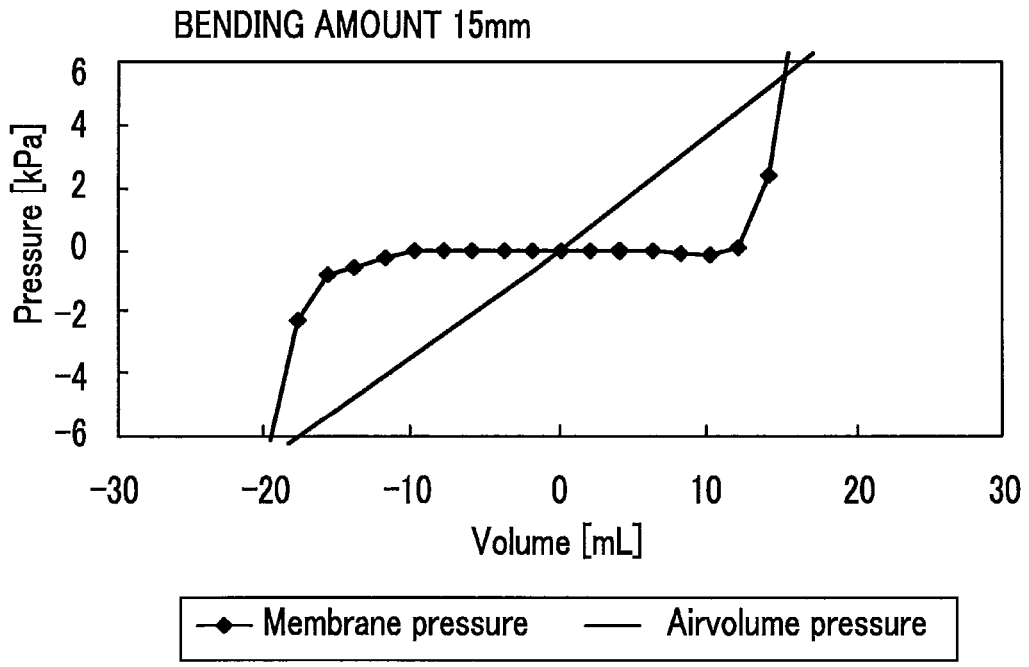
Figure 6:
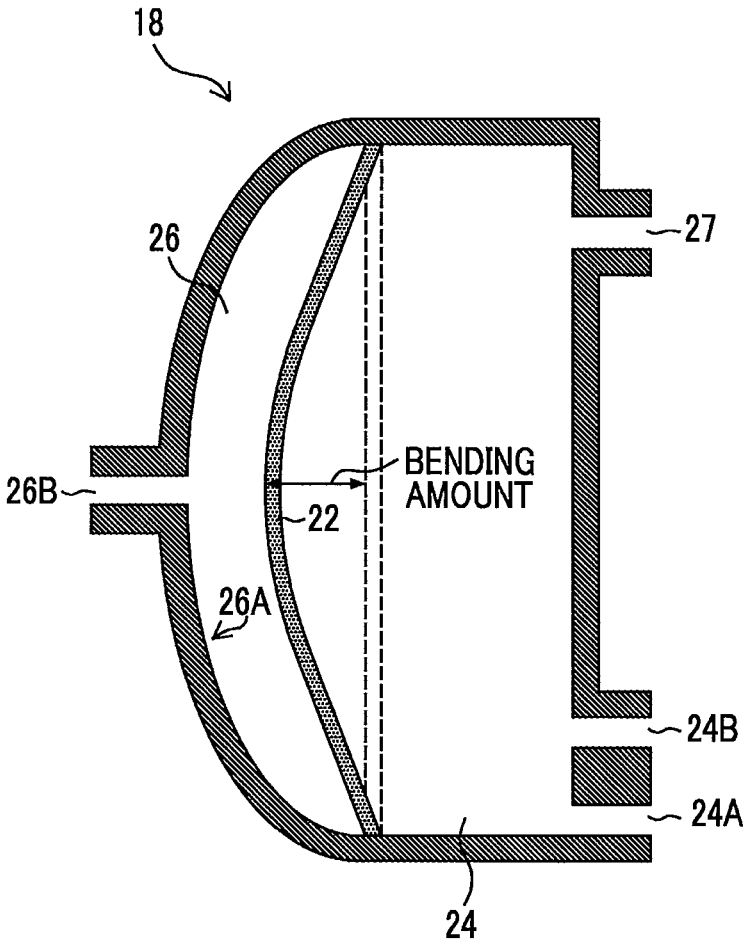
FIG. 6 is a diagram for explaining the bending amount of the elastic membrane.

Therefore, in this embodiment, the elastic membrane 22 is provided with initial bending in advance. Bending mentioned here is not bending formed by plastic deformation or the like but indicates bending that occurs due to the looseness of the membrane. FIGS. 5A to 5C are graphs showing the negative pressure characteristics of the elastic membrane 22 and the gas chamber 26 at each bending amount of the elastic membrane 22 when the size of the liquid chamber 24 is ϕ40 mm, FIG. 5A shows a case without initial bending (a bending amount of 0 mm), FIG. 5B shows a case of a bending amount of 5 mm, and FIG. 5C shows a bending amount of 15 mm. As illustrated in FIG. 6, the bending amount is represented by a difference between the position of the apex of the elastic membrane 22 in a case where the elastic membrane 22 provided with initial bending is caused to have a bowl shape (dome shape) so as to be close to the gas chamber 26 side (or the liquid chamber 24 side) until looseness disappears and the position of the apex of the elastic membrane 22 (the position shown by broken line in FIG. 6) in a case where initial bending is not provided.

As illustrated in FIGS. 5A to 5C, as the bending amount is increased, the effect of the negative pressure characteristics of the elastic membrane 22 in the pressure control region (the range of (±3 kPa) may be reduced. That is, as the bending amount is increased, the loose region of the elastic membrane 22 is enlarged and thus control performance is enhanced. However, since a clearance between the elastic membrane 22 and the wall of the gas chamber 26 is needed, when the bending amount is increased, the gas chamber 26 is increased in size. Therefore, the optimal value of the bending amount of the elastic membrane 22 is obtained depending on the control performance of the negative pressure characteristics and the size of the gas chamber 26.

Such initial bending of the elastic membrane 22 may be achieved by using a membrane that is greater than the diameter of the liquid chamber 24 (gas chamber 26) and fixing the membrane in a state where the membrane is loose.

Figure 7:
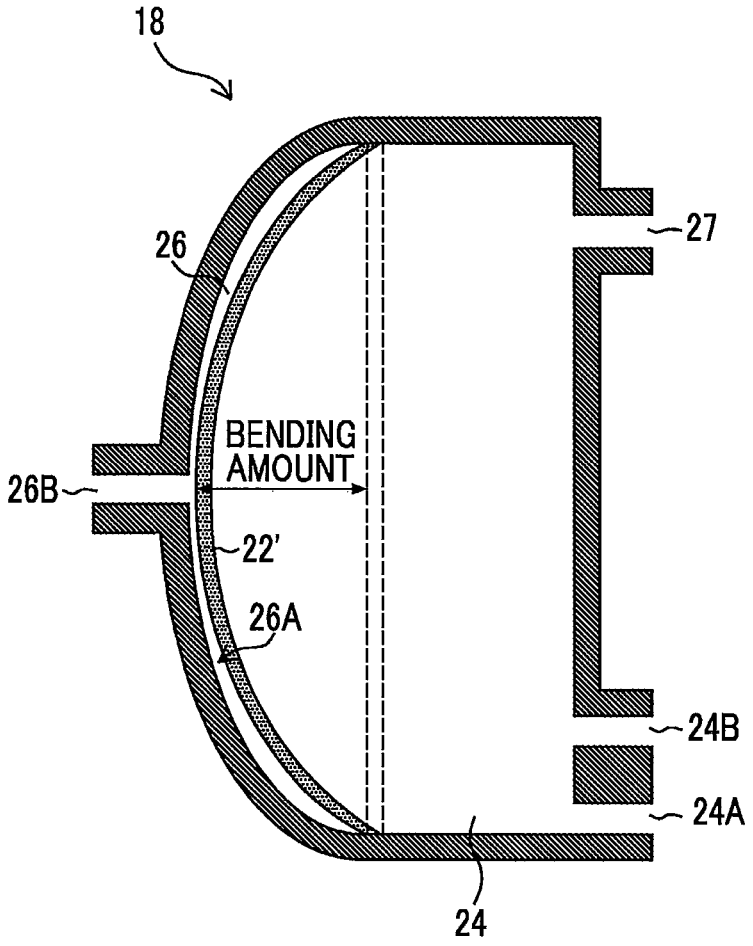
FIG. 7 is a diagram illustrating the elastic membrane having a three-dimensional shape that follows the shape of the inner surface of the gas chamber.

In addition, as illustrated in FIG. 7, an elastic membrane 22' which follows the shape of the opposing surface 26A of the gas chamber 26, that is, has a three-dimensional shape following the shape of the opposing surface 26A of the gas chamber 26 may be used. In the case of the elastic membrane 22', the bending amount thereof is determined by the three-dimensional shape. In this case, after fixing the elastic membrane 22', adjustment of an initial position described later is performed, thereby realizing the initial bending state illustrated in FIG. 2. Using the elastic membrane 22', it becomes easy for the elastic membrane 22' to follow the opposing surface 26A of the gas chamber 26 during a pressurization purge described later, and thus a load on the elastic membrane 22' is reduced. As a result, the life span of the elastic membrane 22' may be increased.

In addition, in the example of FIG. 7, the elastic membrane 22' is fixed as being bent so that the gas chamber 26 side thereof becomes convex in the three-dimensional shape. However, a form in which the elastic member 22' is fixed while being bent so that the liquid chamber 24 side thereof becomes convex in a three-dimensional shape is also possible as long as the elastic membrane 22' is a membrane having durability.

Configuration of Control System of Non-Circulation Type Ink Supply Device

Figure 8:
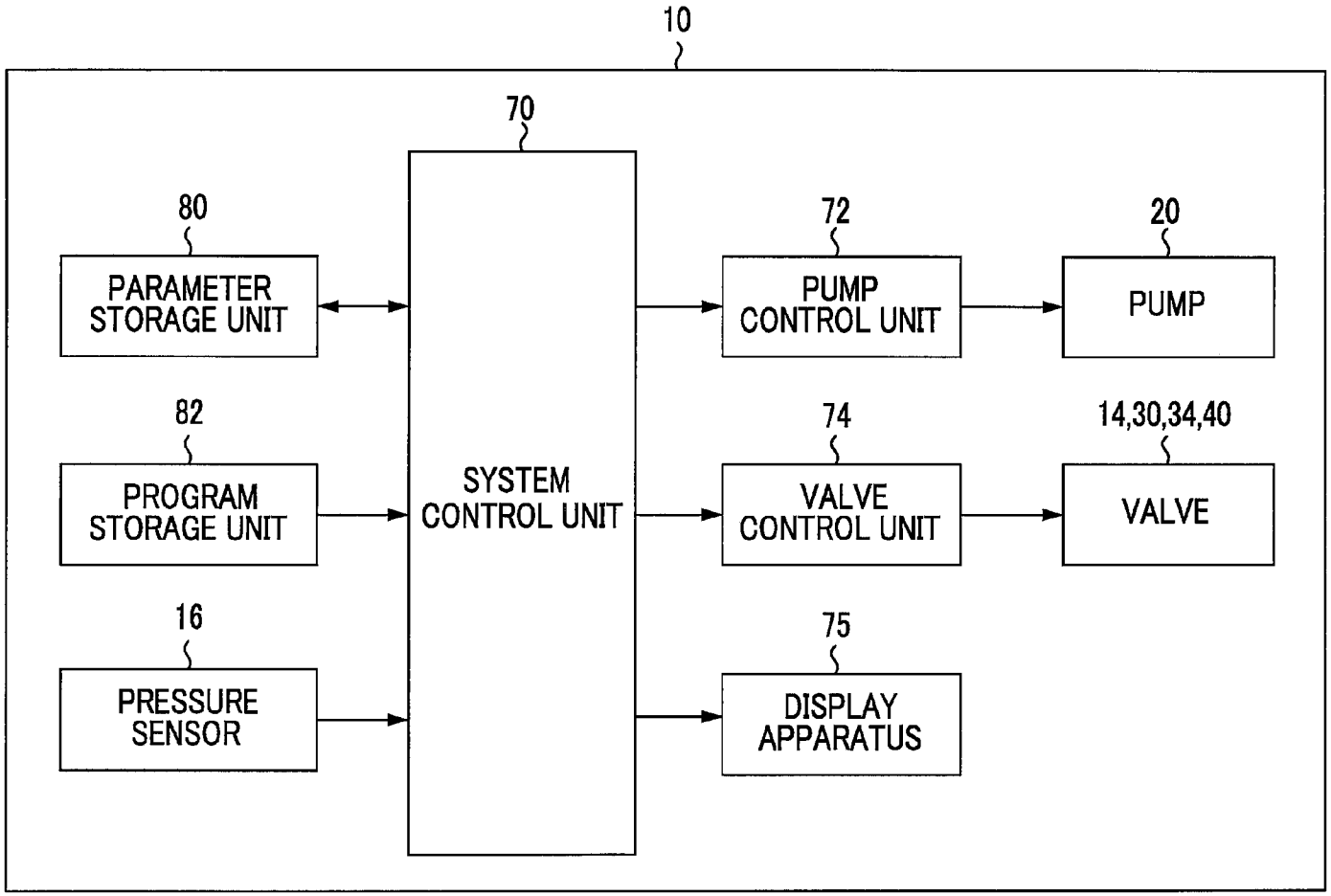
FIG. 8 is a block diagram illustrating the configuration of a control unit applied to the ink supply device illustrated in FIG. 1.

FIG. 8 is a block diagram illustrating the schematic configuration of a control system of the ink supply device 10 illustrated in this example. The ink supply device 10 illustrated in this figure includes: a system control unit 70 that collectively controls the control system; a pump control unit 72 that performs control of the supply pump 20 based on control signals sent from the system control unit 70; a valve control unit 74 that controls opening and closing of valves including the supply valve 14, the drain valve 30, the air connection valve 34, the air valve 40, and the like; and a display 75 that makes a notification in a case where each unit of the apparatus has an error.

A parameter storage unit 80 illustrated in FIG. 8 stores various parameters used for control of the ink supply device 10 and data tables that are referred to during control. For example, a data table described later, which shows the relationship between the volume of the liquid chamber 24 and the detection pressure of the pressure sensor 16, is stored.

A program storage unit 82 stores programs used for control of the ink supply device 10. The system control unit 70 (a control part) reads and executes various control programs stored in the program storage unit 82, and collectively controls the ink supply device 10 with reference to various parameters or data tables stored in the parameter storage unit 80.

In the ink supply device 10 illustrated in this example, based on pressure information of the supply passage 12 (see FIG. 1) obtained by the pressure sensor 16, the operations of the valves such as the supply valve 14 are controlled, and the operation of the supply pump 20 is controlled.

Specifically, based on the detection results of the pressure sensor 16, the system control unit 70 controls driving of the supply pump 20 so that the internal pressure of the supply passage 12 is adjusted to a predetermined pressure. The pressure information (a pressure increase value described later) obtained by the pressure sensor 16 is sequentially written on a predetermined memory and is updated.

In addition, the ink supply device 10 illustrated in this example includes a timer (not shown) to measure a time that elapses from a switching timing of pressure control or a time that elapses from opening and closing of valves, and the measurement results are sequentially written on the memory (not shown).

Figure 9:
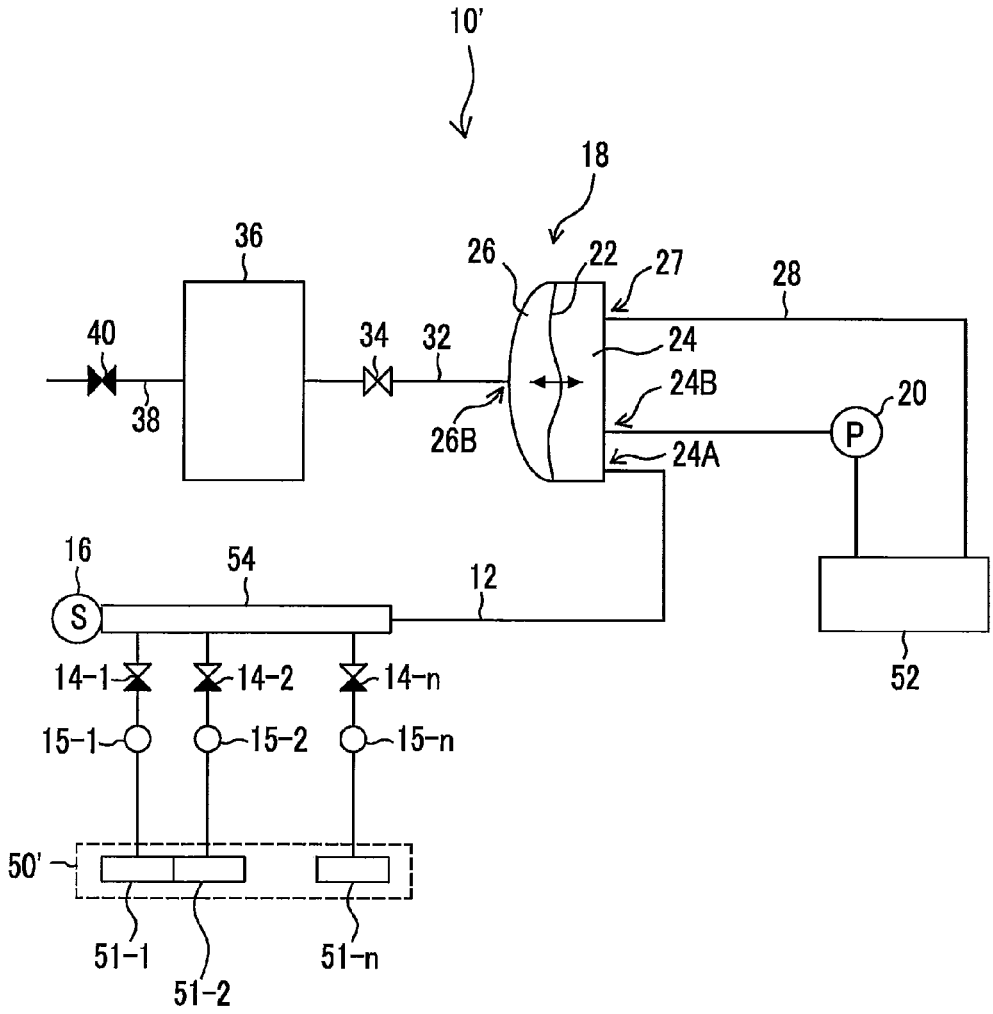
FIG. 9 is a block diagram illustrating a configuration example in which the ink supply device illustrated in FIG. 1 is applied as an ink supply device of an ink jet head.

Next, a configuration example in a case where the non-circulation type ink supply device 10 is applied as an ink supply device of a multi-type ink jet head will be described. The configuration example illustrated in FIG. 9 shows an example in which ink is supplied to an ink jet head 50' from a non-circulation type ink supply device 10'. In addition, in FIG. 9, like elements that are the same as or similar to those of FIG. 1 are denoted by like reference numerals, and description thereof will be omitted.

The head 50' illustrated in FIG. 9 is configured by connecting n head modules 51-1 to **51-*n* to one another. Ink is supplied to the head modules 51 constituting the head 50' via passages individually divided from a supply side manifold 54 that communicates with the supply passage 12 to correspond to the respective head modules 51. The individual passages are provided with supply valves 14-1 to 14-*n* and dampers 15-1 to 15-*n***, respectively.

In the ink supply devices 10 and 10' described above, during initialization of the position of the elastic membrane 22 provided in the supply sub-tank 18 (during initial position adjustment) and during a pressurization purge of the head 50 (50'), opening and closing of the supply valve 14, the air connection valve 34, and the air valve 40 are controlled and switching of the rotation direction of the supply pump 20 is performed. Next, control of the supply valve 14, the air connection valve 34, and the air valve 40 and control of the supply valve 20 will be described in detail.

Initial Position Adjustment of Elastic Membrane

Figure 10:
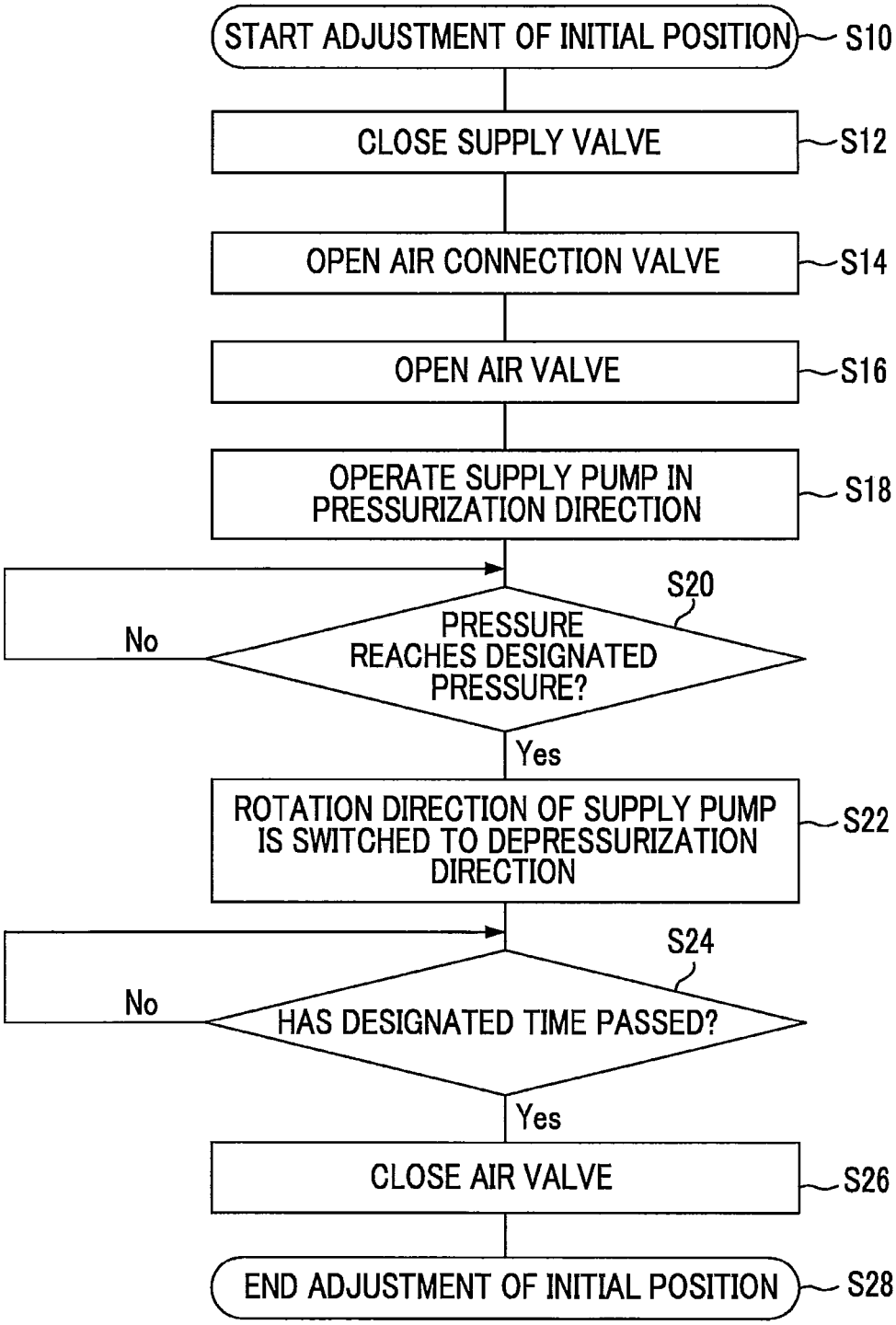
FIG. 10 is a flowchart showing the flow of control of initial position adjustment of the elastic membrane illustrated in FIG. 1.

FIG. 10 is a flowchart showing the flow of control of the initial position adjustment of the elastic membrane 22. In the supply sub-tank 18 (see FIGS. 1 and 2) illustrated in this example, the deformation amount (position) of the elastic membrane 22 changes with time, and when the position of the elastic membrane 22 changes, variations in pressure control of the supply passage 12 occur. Therefore, the initial position adjustment of the elastic membrane 22 is appropriately performed to avoid variations in the pressure control of the supply passage 12. As a timing at which the initial position adjustment of the elastic membrane 22 is performed, there are the time of the start-up of the apparatus and the time when the pressure in the supply passage 12 significantly changes due to errors and the like of the supply pump 20 after the execution of the pressurization purge.

As shown in FIG. 10, when the initial position adjustment of the elastic membrane 22 is started (Step S10), the supply valve 14 is closed (Step S12), and thus the supply passage 12 and the head 50 do not communicate with each other. Thereafter, the air connection valve 34 is opened (Step S14), and the air valve 40 is opened (Step S16). As a result, the gas chamber 26 and the air tank 36 communicate with each other, and the gas chamber 26 and the air tank 36 are released to the air. When the inside of the liquid chamber 24 is pressurized by rotating the supply pump 20 forward in this state, ink is sent into the liquid chamber 24 (Step S18). In addition, the pressure detected by the pressure sensor 16 is monitored.

In Step S20, it is monitored whether or not the detection pressure of the pressure sensor 16 reaches a designated pressure, and in a case where the detection pressure of the pressure sensor 16 does not reach the designated pressure (determination of No), pressurization and pressure monitoring are continuously performed. On the other hand, when the detection pressure of the pressure sensor 16 reaches the designated pressure (determination of Yes), the rotation direction of the supply pump 20 is switched to a depressurization direction (Step S22). In addition, the "designated pressure" indicates a pressure determined in advance in a range in which the volume and the pressure of the liquid chamber 24 maintain a proportionate relationship.

Figure 11A:
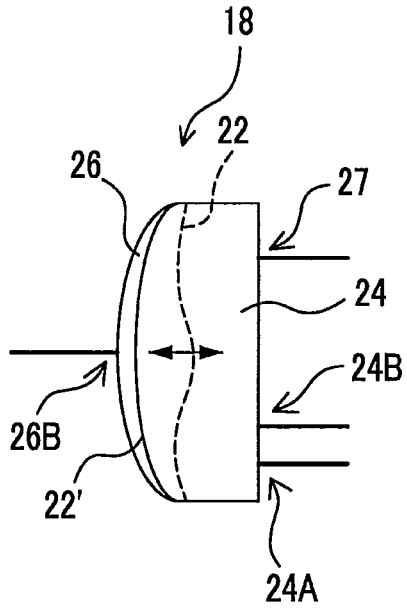
FIGS. 11A and 11B are diagrams for explaining the deformation state of the elastic membrane during the initial position adjustment of the elastic membrane illustrated in FIG. 1.

FIG. 11A schematically illustrates the supply sub-tank 18 in a state where the pressure has reached the designated pressure. As the inside of the liquid chamber 24 is pressurized, the elastic membrane 22 (the elastic membrane at the initial position is shown by a broken line) deforms toward the gas chamber 26, and a deformation amount thereof increases as time has elapsed. As a result, the elastic membrane 22 becomes in a state as shown by full line denoted by reference numeral 22'.

From the state where the pressure reaches the designated pressure as illustrated in FIG. 11A, when the supply pump 20 is operated to be depressurized at a predetermined speed and a predetermined amount of ink is discharged from the liquid chamber 24 per unit time, the elastic membrane 22 deforms toward the liquid chamber 24, and the deformation amount of the elastic membrane 22 is proportionate to the discharge amount of the ink.

Returning to FIG. 10, in Step S24, in a case where the time that has elapsed from the start of the depressurization is monitored and a predetermined time has not elapsed from the start of the depressurization (determination of No), the depressurization operation of the supply pump 20 and monitoring of the elapsed time are continuously performed. On the other hand, when the predetermined time has elapsed from the start of the depressurization operation (determination of Yes), the air valve 40 is closed (Step S26). That is, when a predetermined amount of ink is discharged from the state illustrated in FIG. 11A by the full line denoted by reference numeral 22' in the liquid chamber 24, the elastic membrane 22 deforms by a predetermined amount according to the discharge amount of the ink in a direction in which the liquid chamber 24 is contracted and is adjusted to the determined initial position. Thereafter, the gas chamber 26 and the air tank 36 are blocked from the air while maintaining a communicating state, and the initial position adjustment of the elastic membrane 22 is ended (Step S28).

Figure 11B:
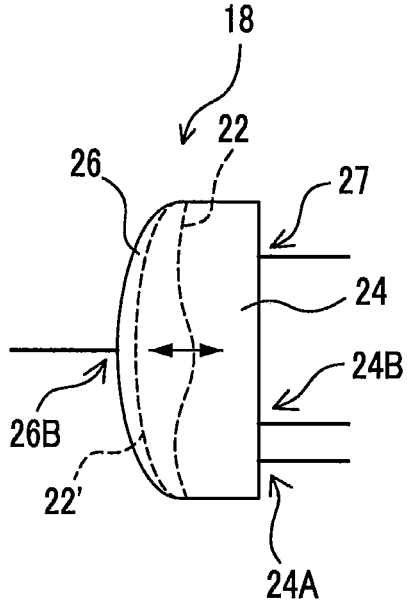

FIG. 11B schematically illustrates a state of the supply sub-tank 18 when a predetermined time has elapsed after the depressurization is started by depressurizing the liquid chamber 24 from the designated pressure state. In this figure, the elastic membrane at the position in the designated pressure state is shown by the broken line denoted by reference numeral 22', and the elastic membrane at the initial position is shown by the full line denoted by reference numeral 22.

Figure 12:
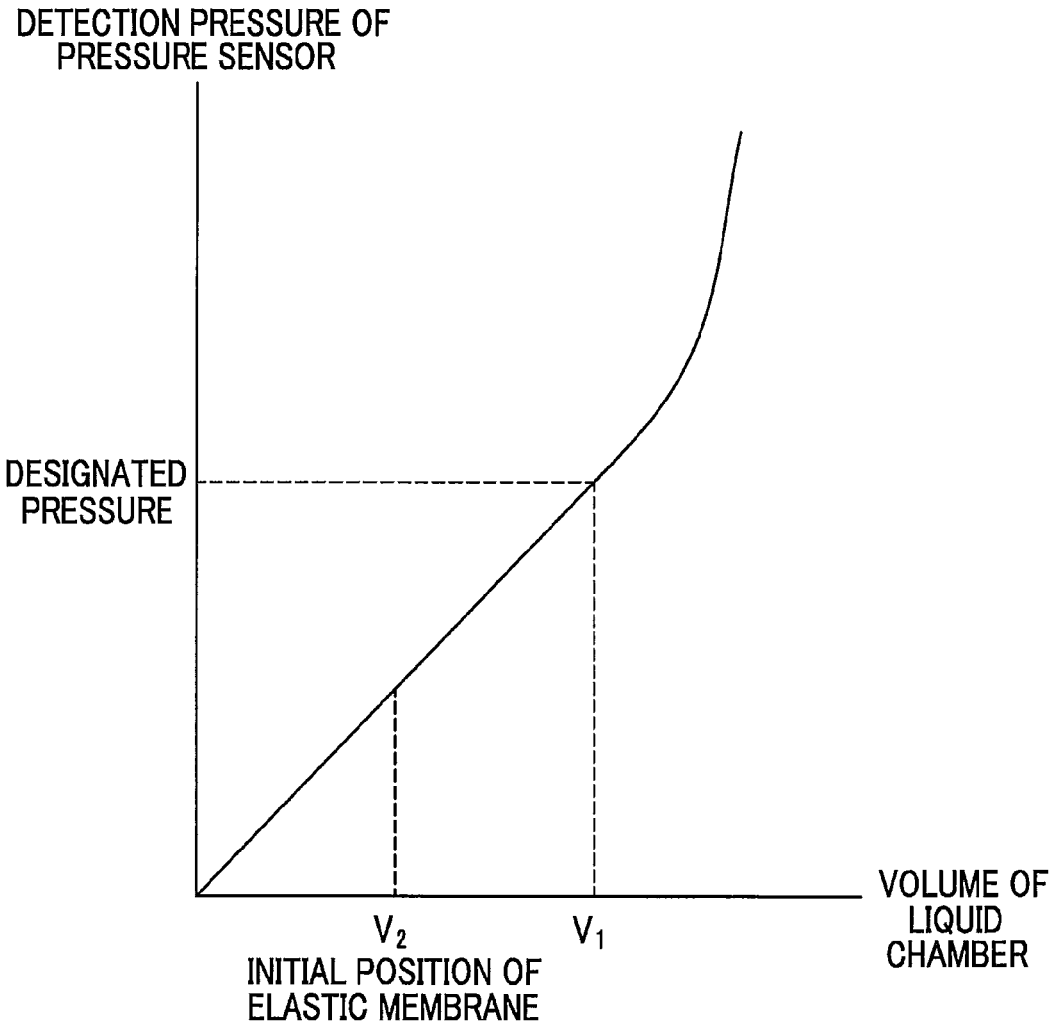
FIG. 12 is a diagram showing the relationship between the volume of the liquid chamber illustrated in FIG. 1 and the detection pressure of the pressure sensor.

FIG. 12 illustrates the relationship between the volume (the inflow amount of ink) of the liquid chamber 24 and the detection pressure of the pressure sensor 16 (see FIG. 1). The detection pressure of the pressure sensor 16 shown in this figure is equivalent to the internal pressure of the liquid chamber 24. As shown in this figure, the internal pressure of the liquid chamber 24 ascertained as the detection pressure of the pressure sensor 16 is proportionate to the volume of the ink that flows into the liquid chamber 24 until the loose region (an elastically deformable region) of the elastic membrane 22 is eliminated. On the other hand, when the volume of the liquid chamber 24 is increased and thus the loose region of the elastic membrane 22 is eliminated, the relationship between the internal pressure of the liquid chamber 24 and the volume of the inflow ink is no more maintained proportionate due to the effect of the elastic membrane 22. When the volume of the liquid chamber 24 is maximized, the internal pressure of the liquid chamber is rapidly increased. In addition, there may be cases where the loose region of the elastic membrane 22 is a region when the volume of the liquid chamber 24 is maximized.

By obtaining the relationship between the internal pressure of the liquid chamber 24 and the volume of the liquid chamber 24 in advance and storing the relationship in a predetermined memory, the internal pressure of the liquid chamber 24 is ascertained from the detection pressure of the pressure sensor 16 and the volume of the liquid chamber 24 is ascertained with reference to the memory. A volume V1 of the liquid chamber 24 corresponding to the designated pressure shown in FIG. 12 corresponds to the designated pressure state of the liquid chamber 24 (see FIG. 11A).

In addition, when ink is discharged from the liquid chamber 24 at a constant flow rate, the volume of the ink that flows out from the liquid chamber 24 may be obtained by multiplying the discharge amount per unit time by the discharge time. Therefore, the supply pump 20 is operated to be reversed (depressurization operation) at a constant rotation frequency, and the volume of the ink discharged from the liquid chamber 24 from the operation time may be ascertained. A volume V2 of the liquid chamber 24 illustrated in FIG. 12 represents the volume of the liquid chamber 24 when the position of the elastic membrane 22 is adjusted to the initial position.

As described above, as the initial position adjustment of the elastic membrane 22 is appropriately performed, variations in pressure control due to time passage may be avoided, and thus stable liquid supply is realized.

Pressurization Purge

Next, the execution of a pressurization purge in which ink in the head 50 is forcibly discharged by causing the internal pressure of the head 50 (see FIG. 1) to be a positive pressure will be described. Specifically, the control of the supply valve 14, the air connection valve 34, and the air valve 40 and the control of the supply pump 20 executed in the process of the pressurization purge will be described.

Figure 13:
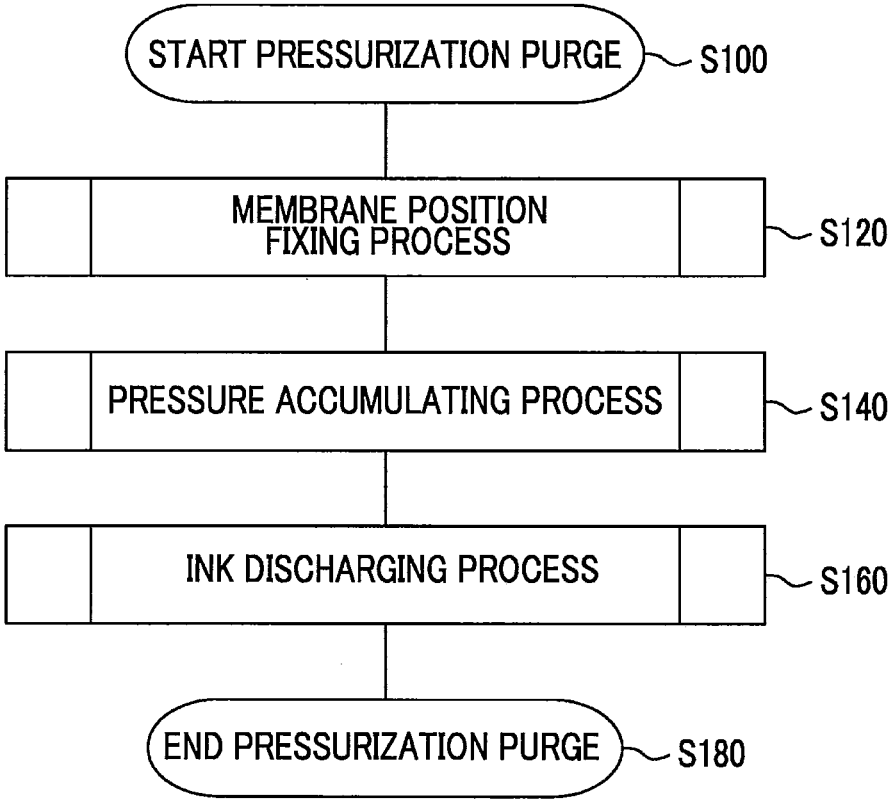
FIG. 13 is a flowchart showing the flow of control of a pressurization purge.

FIG. 13 is a flowchart showing the flow of the control of the pressurization purge. As shown in this figure, the pressurization purge includes a membrane position fixing process (Step S120), a pressure accumulating process (Step S140), and ink discharging process (Step S160).

Figure 14:
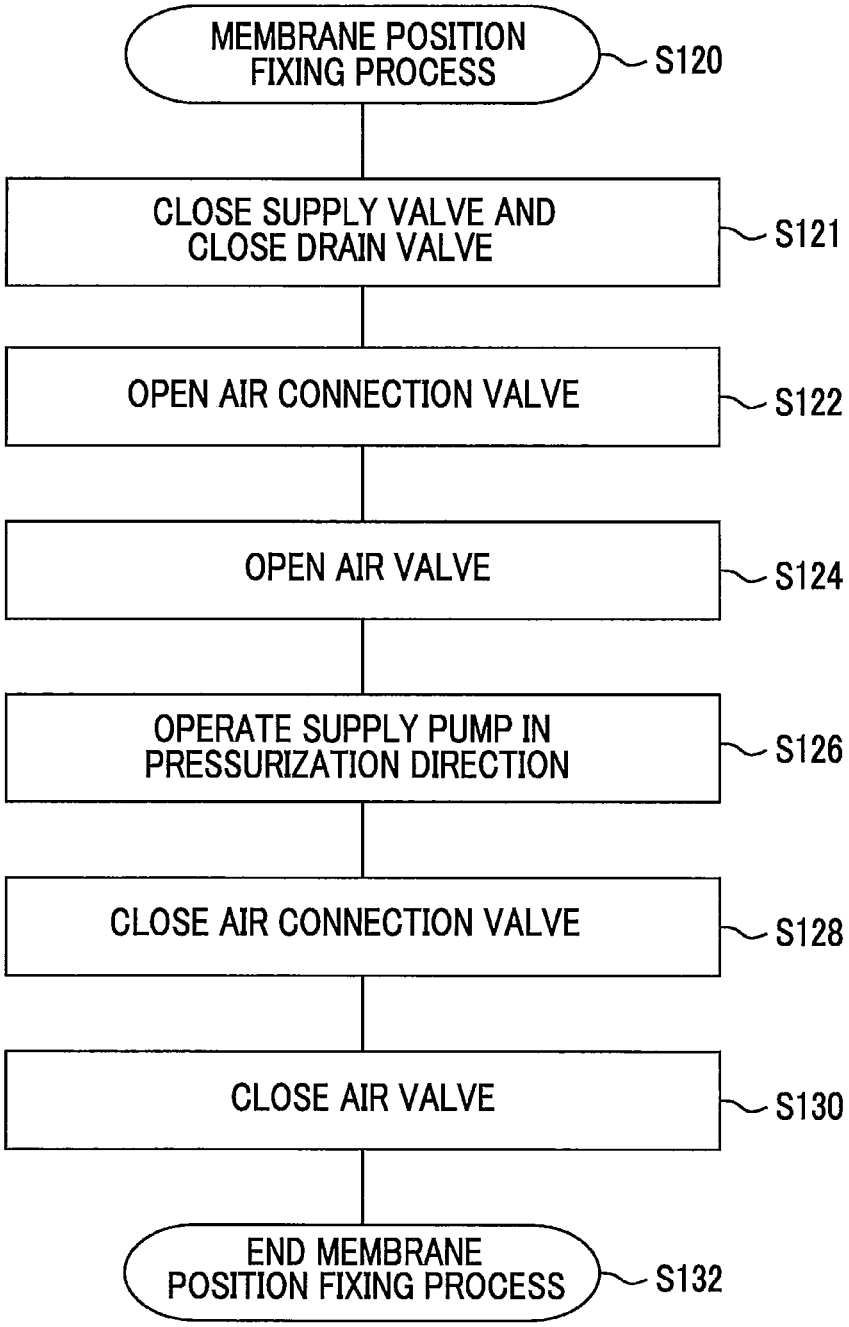
FIG. 14 is a flowchart showing the flow of control of a membrane position fixing process in the control of the pressurization purge shown in FIG. 13.

FIG. 14 is a flowchart of the membrane position fixing process (Step S120). The membrane position fixing process is a process of deforming the elastic membrane 22 to be in a state of being attached to the opposing surface 26A of the gas chamber 26. When the membrane position fixing process is started, the supply valve 14 and the drain valve 30 are closed (Step S121), the air connection valve 34 is opened (Step S122), the air valve 40 is opened (Step S124), and the gas chamber 26 and the air tank 35 communicate with each other and communicate with the air. In this state, the supply pump 20 is operated to rotate forward and the inside of the liquid chamber 24 is pressurized, thereby causing the elastic membrane 22 to be in a state of being attached to the opposing surface 26A of the gas chamber 26 (Step S126).

When the elastic membrane 22 enters the state of being attached to the opposing surface 26A of the gas chamber 26, the air connection valve 34 is closed (Step S128), the air valve 40 is closed (Step S130), and the membrane position fixing process is ended (Step S132). By the membrane position fixing process, the elastic membrane 22 is fixed in the state of being attached to opposing surface 26A of the gas chamber 26, the gas chamber 26 and the air tank 36 do not communicate with each other, and the gas chamber 26 is blocked from the air.

Figure 15:
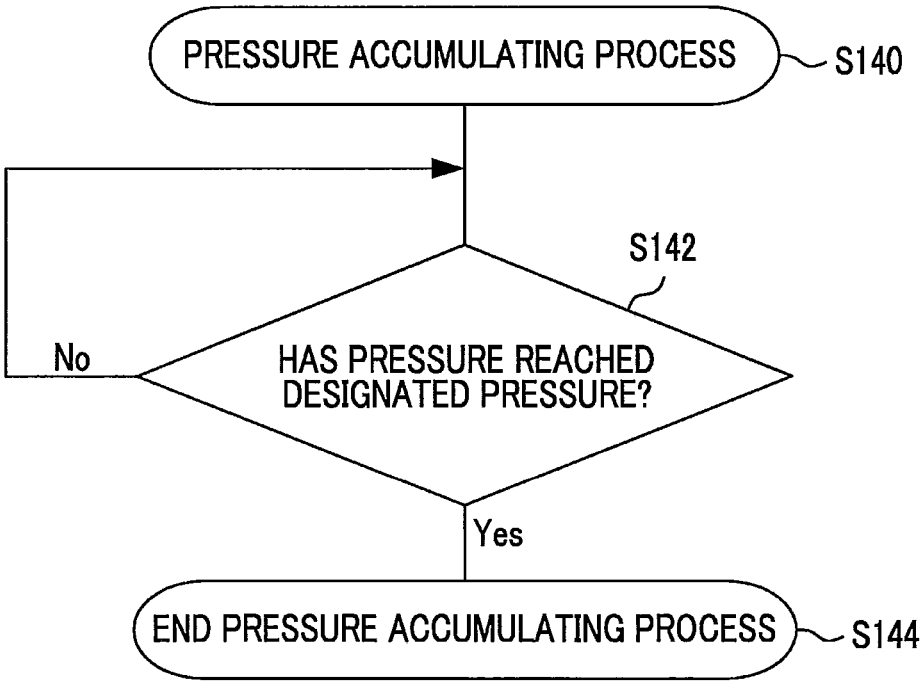
FIG. 15 is a flowchart showing the flow of control of a pressure accumulating process in the control of the pressurization purge shown in FIG. 13.

FIG. 15 is a flowchart of the pressure accumulating process. When the elastic membrane 22 is fixed in the state of being attached to the opposing surface 26A of the gas chamber 26 by the membrane position fixing process shown in FIG. 14, the pressure accumulating process is started. The pressure accumulating process is a process of collecting a pressure needed for a purge in the supply sub-tank 18 (and the supply passage 12) by filling the liquid chamber 24 in the maximum volume state with ink. That is, in the pressure accumulating process, in the state where the supply valve 14 is closed, the liquid chamber 24 is pressurized while monitoring the detection pressure of the pressure sensor 16, and pressurization is continuously performed until the detection pressure of the pressure sensor 16 reaches the designated pressure (Step S142). When the detection pressure of the pressure sensor 16 reaches the designated pressure, the liquid chamber 24 and the supply passage 12 are filled with ink, a predetermined pressure is stored in the supply sub-tank 18 and the supply passage 12, and the pressure accumulating process is ended (Step S144).

Figure 16:
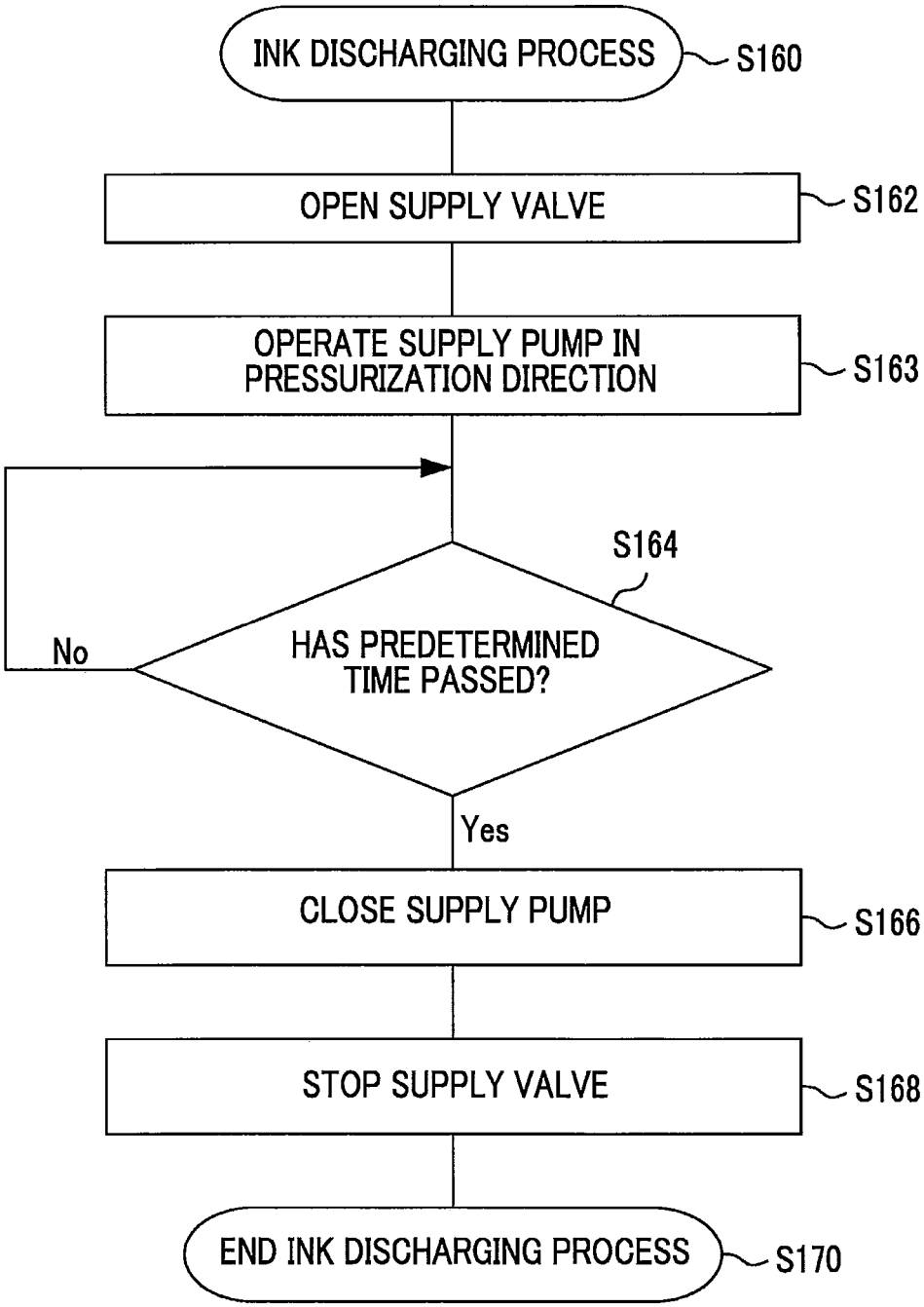
FIG. 16 is a flowchart showing the flow of control of an ink discharging process in the control of the pressurization purge shown in FIG. 13.

FIG. 16 is a flowchart of the ink discharging process. The ink discharging process is a process of discharging (purging) ink from the nozzles of the head 50 using the pressure accumulated by the pressure accumulating process. First, the supply valve 14 is opened (Step S162). Then, as the ink accumulated in the pressure accumulating process flows into the head 50, the internal pressure of the head 50 becomes a positive pressure, and thus ink is discharged from the head 50. Here, the supply pump 20 is operated in the pressurization direction so as not to reduce the internal pressure of the head 50 (Step S163).

When the discharge of the ink is started, a time that has elapsed after the supply valve 14 is opened is monitored (Step S164). When a predetermined time has elapsed (determination of Yes), the supply valve 14 is closed (Step S166), the supply pump 20 is stopped (Step S168), and the ink discharging process is ended (Step S170). When the pressurization purge shown in FIGS. 13 to 16 is ended, valve control and pump control are transitioned to a predetermined state.

When a pressurization purge is performed, the elastic membrane 22 is fixed in the state in which the volume of the liquid chamber is maximized (in a state where pressure losses due to pressure buffering do not occur), and a pressure is stored in the supply sub-tank 18 and the supply passage 12 in this state. Accordingly, a time to store the pressure in the supply sub-tank 18 is reduced, and a pressure wave of the pressurization purge becomes sharp (pressurization characteristics based on a sharp pressurization curve may be obtained). Therefore, there is an advantage that bubbles and foreign matter are easily removed from the nozzles.

According to the ink supply device 10 configured as described above, since the initial position of the elastic membrane 22 that separates the liquid chamber 24 and the gas chamber 26 from each other in the supply sub-tank 18 is appropriately adjusted, the deformation amount (position) of the elastic membrane 22 does not change with time, and variations in pressure control are avoided.

In addition, during the execution of the pressurization purge, since the pressure is stored in the supply sub-tank 18 and the supply passage 12 after the elastic membrane 22 is fixed in the state where the volume of the liquid chamber is maximized (i.e., the state in which pressure loss due to the pressure buffering does not occur), a time required to store the pressure in the supply sub-tank 18 is reduced, and a pressure wave of the pressurization purge becomes sharp (i.e., the pressurization characteristic based on a sharp pressurization curve is obtained). Therefore, there is an advantage that bubbles and foreign matter are easily removed from the nozzles.

Second Embodiment

Figure 17:
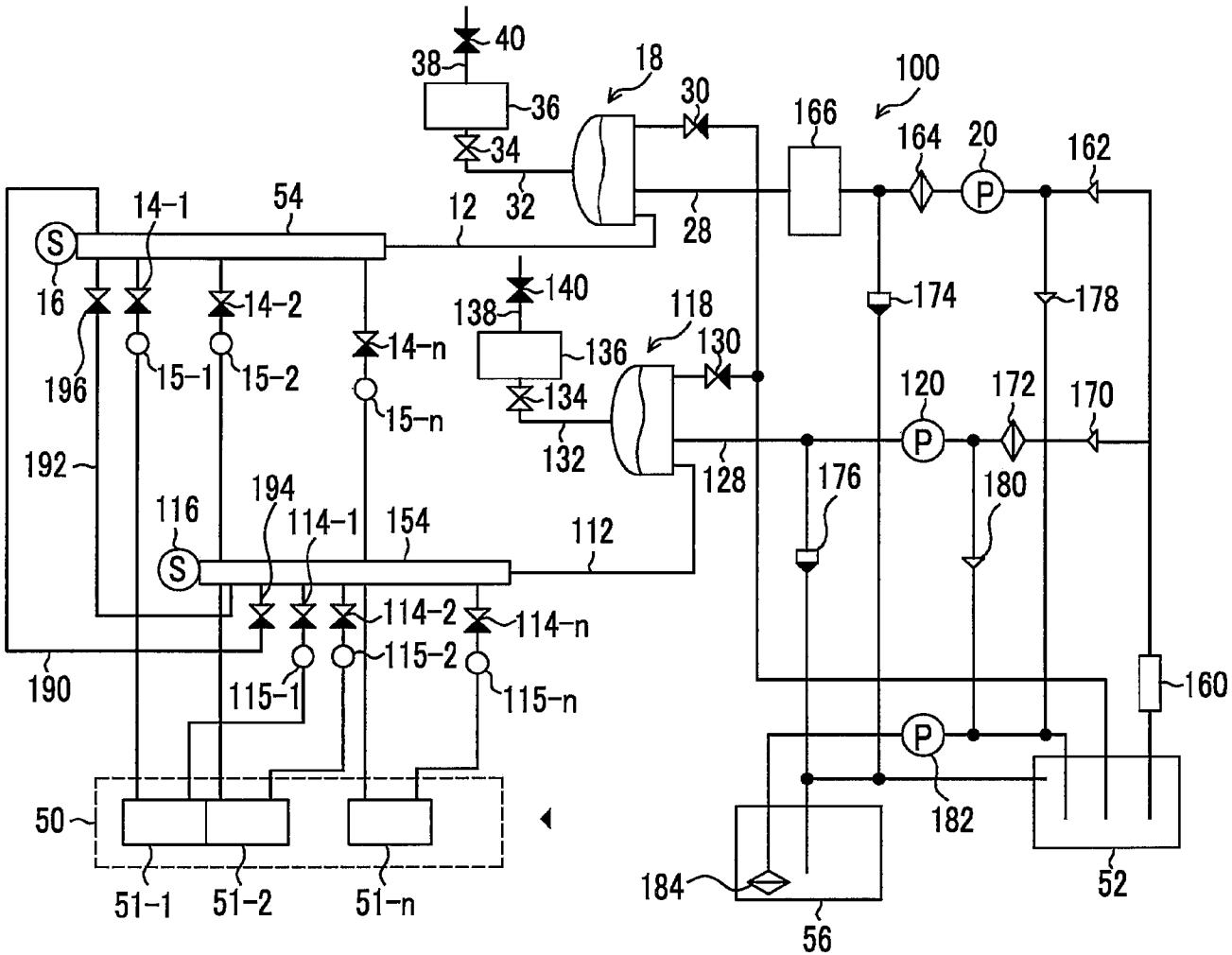
FIG. 17 is a block diagram illustrating the schematic configuration of a circulation—type ink supply device according to a second embodiment of the present invention.

Next, an ink supply device according to a second embodiment of the present invention will be described. The ink supply device 100 illustrated in FIG. 17 is of a circulation type including a circulation system and is thus different from the non-circulation type ink supply device illustrated in FIG. 1. In the following description, a different configuration from that of the ink supply device 10 according to the first embodiment mainly described above will be described.

Entire Configuration

The ink supply device 100 illustrated in FIG. 17 includes a supply passage 12 as a liquid supply passage and a recovery passage 112 as a liquid recovery passage. The supply passage 12 is provided with a supply passage pressure sensor 16 (equivalent to the pressure sensor 16 illustrated in FIG. 1) as a first pressure detecting part, and the recovery passage 112 is provided with a recovery passage pressure sensor 116 as a second pressure detecting part. In addition, the supply passage 12 is provided with a supply sub-tank 18 as a first pressure buffering unit, and the recovery passage 112 is provided with a recovery sub-tank 118 as a second pressure buffering unit. The supply sub-tank 18 communicates with a supply pump 20 as a first liquid pressure applying part and an ink tank 52 via a predetermined ink passage. The recovery sub-tank 118 communicates with a recovery pump 120 as a second liquid pressure applying part and the ink tank 52 via a predetermined ink passage.

A head 50 illustrated in FIG. 17 is a head having a structure in which n head modules 51-1, 51-2, . . . , **51-*n* are connected to one another, and the head modules 51 communicate with the supply passage 12 respectively via supply valves 14-1, 14-2, . . . , 14-*n* and communicate with the recovery passage 112 respectively via recovery valves 114-1 114-2, . . . , 114-*n***.

A supply side manifold 54 and a recovery side manifold 154 are temporary ink storage units provided between the supply passage 12 and the recovery passage 112, and the head 50, respectively. The supply side manifold 54 and the recovery side manifold 154 communicate with each other through bypass passages 190 and 192, and the bypass passages 190 and 192 are respectively provided with bypass passage valves 194 and 196.

As the supply pump 20 and the recovery pump 120, tube pumps are applied. The supply pump 20 illustrated in FIG. 17 controls the pressure (the amount of sent ink) of the supply passage 12 that supplies ink from the ink tank (buffer tank) 52 to the head 50, and the recovery pump 120 controls the pressure of the recovery passage 112 that recovers (circulates) ink to the ink tank 52 from the head 50. As the supply pump 20 and the recovery pump 120, pumps that have the same performance (capacity) may be applied.

The supply pump 20 and the recovery pump 120 are rotated in only one direction in a period in which the head 50 stops operating (that is, a period in which ink stably flows). When the internal pressure is reduced in a period in which the head 50 performs a discharging operation, the rotation frequency of the supply pump 20 is increased, and the recovery pump 120 is reversed to increase the internal pressure of the head 50.

That is, driving of the supply pump 20 and the recovery pump 120 is controlled so that the internal pressure of the supply passage 12 is relatively higher than the internal pressure of the recovery passage 112 or a predetermined back pressure (negative pressure) is applied to the ink in the nozzles of the head 50.

Since the supply sub-tank 18 and the recovery sub-tank 118 have the same structure as the supply sub-tank 18 illustrated in FIG. 2, description thereof will be omitted. That is, each of the supply sub-tank 18 and the recovery sub-tank has a structure in which a liquid chamber (a first liquid chamber and a second liquid chamber) and a gas chamber (a first gas chamber and a second gas chamber) are partitioned by an elastic membrane (a first flexible membrane and a second flexible membrane). The gas chamber of the supply sub-tank 18 and the gas chamber of the recovery sub-tank are configured so that the surface of the inner wall thereof that opposes the elastic membrane is a curved surface. In addition, the elastic membranes of the supply sub-tank 18 and the recovery sub-tank 118 are provided with initial bending in advance.

In addition, the supply sub-tank 18 and the recovery sub-tank 118 may have the same structure as the supply sub-tank 18 illustrated in FIG. 7. That is, the elastic membranes of the supply sub-tank 18 and the recovery sub-tank 118 may have a three-dimensional shape that follows the shape of the opposing surface 26A of the gas chamber 26.

In addition, a drain passage 128, a drain valve 130, a gas passage 132, an air connection valve 134 (a second air communication passage switching part), an air tank 136, an air communication passage 138, an air valve 140 of the circulation system (recovery side) illustrated in FIG. 17 respectively correspond to the drain passage 28, the drain valve 30, the air passage 32, the air connection valve 34, the air tank 36, the air communication passage 38, the air valve 40 (a first air communication switching part) of the supply system.

In addition, a latch type electromagnetic valve is applied as the drain valve 130, a normally open electromagnetic valve is applied as the air connection valve 134, and normally closed electromagnetic valves are applied as the supply valve 14, the recovery valve 114, and the air valve 140.

In the ink supply device 100 illustrated in FIG. 17, a degassing module 160 and a one-way valve 162 for preventing the backflow of the ink are provided between the ink tank 52 and the supply pump 20, and a filter 164 and a heat exchanger (cooling and heating device) 166 are provided between the supply pump 20 and the supply sub-tank 18. The ink sent from the ink tank 52 is subjected to a degassing process by the degassing module 160, is subjected to removal of bubbles or foreign matter by the filter 164, is subjected to a temperature adjustment treatment by the heat exchanger 166, and is thereafter sent to the supply sub-tank 18.

In addition, between the degassing module 160 and the recovery pump 120, a one-way valve 170 for preventing the backflow of ink is provided and a filter 172 is provided. Therefore, even in a case where ink is sent from the ink tank 52 to the recovery sub-tank 118, a predetermined degassing treatment and a filtering process are performed.

Moreover, the ink supply device 100 is provided with safety valves (relief valves) 174 and 176. In a case where an error occurs in the supply pump 20 and the recovery pump 120 and thus the internal pressure of the supply passage 12 and the recovery passage 112 is increased higher than a predetermined value, the safety valves 174 and 176 are operated to reduce the internal pressure of the supply passage 12 and the recovery passage 112. In addition, one-way valves 178 and 180 are provided for preventing the backflow of ink when the supply pump 20 and the recovery pump 120 are operated in reverse.

A main tank 56 illustrated in FIG. 17 stores ink to be supplied to the buffer tank 52. When the amount of ink in the buffer tank 52 is reduced, a replenishing pump 182 is operated to send the ink in the main tank 56 to the buffer tank 52. In the main tank 56, a filter 184 is provided.

Description of Circulation

In the ink supply device 100 having the above configuration, the supply pump 20 and the recovery pump 120 are operated to provide a differential pressure between the supply side manifold 54 and the recovery side manifold 154, thereby circulating ink. For example, in a state where the supply valve 14 and the recovery valve 114 are opened, when a negative pressure is generated in the supply side manifold 54 by operating the supply pump 20 to rotate forward and a negative pressure that is lower than that of the supply side is generated in the recovery side manifold 154 by operating the recovery pump 120 to be reversed, ink flows from the supply side manifold 54 to the recovery side manifold 154 via the head 50, and moreover, the ink may be circulated via the recovery passage 112, the recovery sub-tank 118, and the like.

When ink is circulated, the second bypass passage valve 196 provided in the second bypass passage 192 may be opened to cause the supply side manifold 54 and the recovery side manifold 154 to communicate with each other via the second bypass passage 192. In addition, any one of the first bypass passages 190 and 192 may be provided as long as it has a diameter so as not to cause pressure losses during pressure.

Initial Position Adjustment of Elastic Membrane

In the ink supply device 100 illustrated in FIG. 17, the supply valve 14, the air connection valve 34, the air valve 40, and the supply pump 20 on the supply side and the recovery valve 114, the air connection valve 134, the air valve 140, and the recovery pump 120 on the recovery side may be operated independently from each other. Therefore, the initial position adjustment of the elastic membrane 22 described using FIGS. 10 to 12 may be applied to initial adjustment of the elastic membrane of the recovery sub-tank 118.

Pressurization Purge

Figure 18:
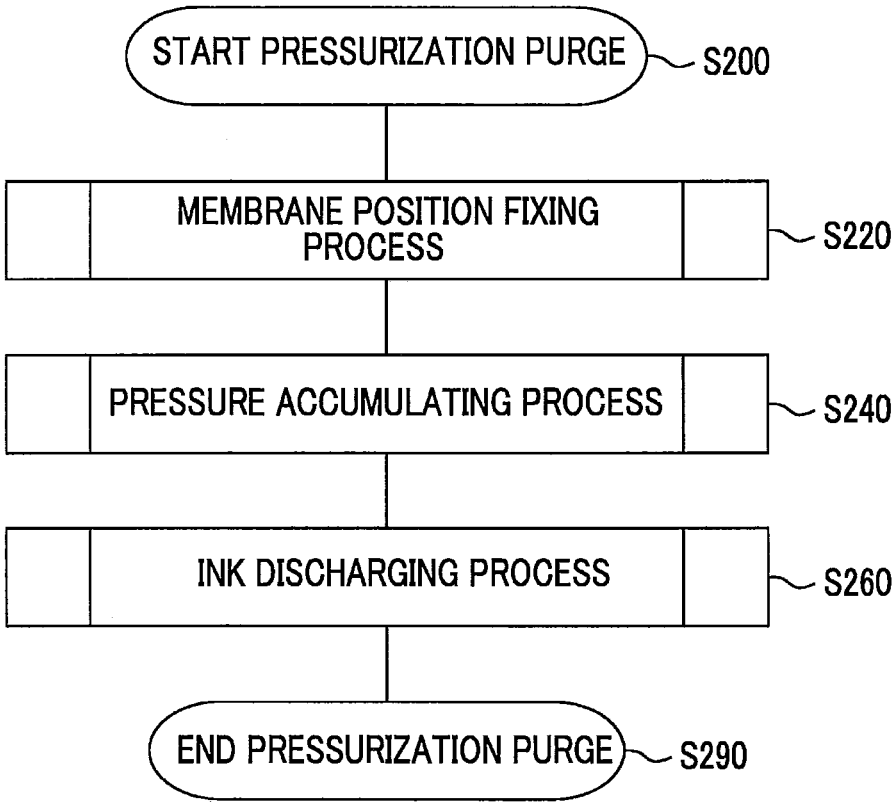
FIG. 18 is a flowchart showing the flow of control of a pressurization purge in the circulation—type ink supply device illustrated in FIG. 17.

The pressurization purge in the ink supply device 100 illustrated in FIG. 17 includes processes shown in FIG. 18. When the pressurization purge is started (Step S200), a membrane position fixing process (S220), a pressure accumulating process (Step S240), an ink discharging process (Step S260) are performed in this order, and the pressurization purge is ended (Step S290). As the membrane position fixing process (Step S220), the processes (Steps S120 to S132) of the membrane position fixing process (S120) shown in FIG. 14 may be applied to the recovery valve 114, the air connection valve 134, the air valve 140, the recovery drain valve 130, and the recovery pump 120.

Figure 19:
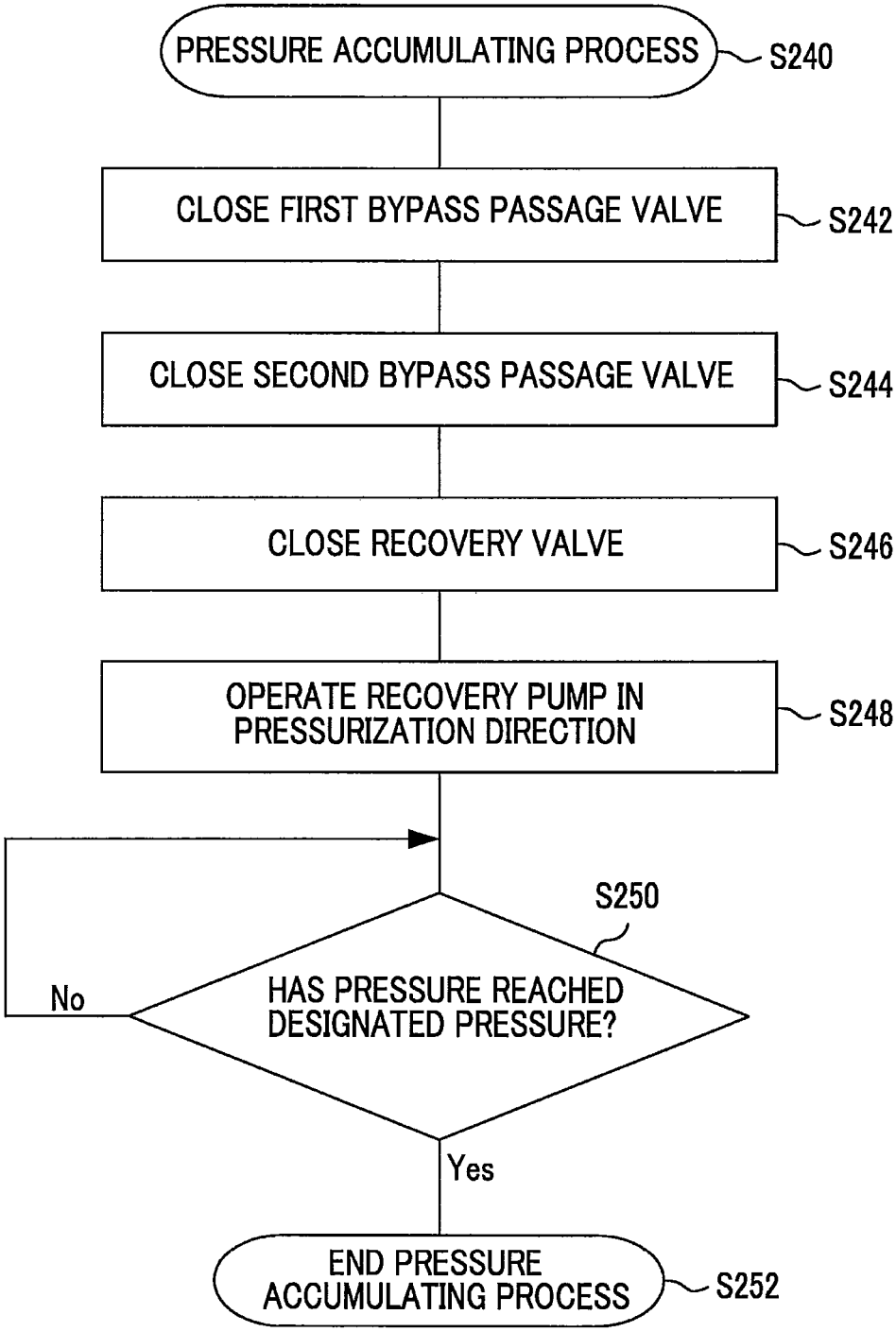
FIG. 19 is a flowchart showing the flow of control of a pressure accumulating process in the control of the pressurization purge shown in FIG. 18.

Details of the pressure accumulating process (S240 of FIG. 18) are shown in FIG. 19. In the pressure accumulating process shown in FIG. 19, after closing the first bypass passage valve 194, the second bypass passage valve 196, and the recovery valve 114 (Steps S242 to 246), the recovery pump 120 is operated in the pressurization direction (Step S248), and a pressure is stored in the recovery sub-tank 118 until the pressure reaches a designated pressure while monitoring the recovery pressure sensor 116 (Step S250).

Figure 20:
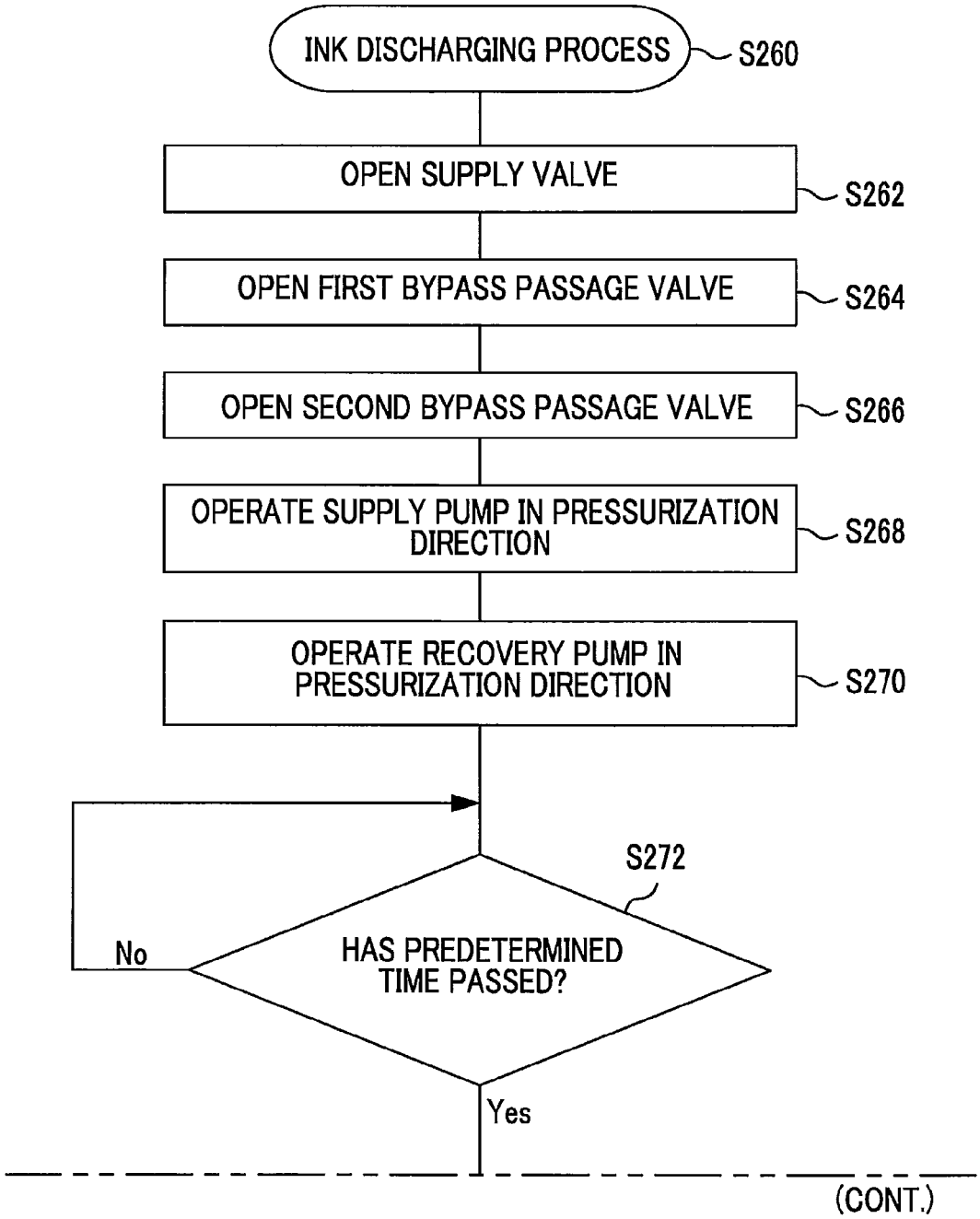
FIG. 20 is a flowchart showing the flow of control of an ink discharging process in the control of the pressurization purge shown in FIG. 18.

In addition, details of the ink discharging process (Step S260 of FIG. 18) are shown in FIG. 20. In the ink discharging process shown in FIG. 20, after opening the supply valve 14 of the passage on which the pressurization purge is performed (Step S262), the first bypass passage valve 194 and the second bypass passage valve 196 are opened (Step S264 to S266). Here, the supply pump 20 and the recovery pump 120 are operated in the pressurization direction so as not to cause the pressure to decrease (Steps S268 to S270).

When a predetermined time has elapsed after discharge of ink is started (determination of Yes in Step S272), the second bypass passage valve 196 is closed (Step S274), and the first bypass passage valve 194 is closed (Step S276) and the supply valve 14 is closed (Step S278). In addition, the recovery pump 120 is stopped (Step S280), the supply pump 20 is stopped (Step S282), and the ink discharging process is ended (Step S284).

In addition, the valve control unit and the pump control unit (see FIG. 8) of the supply system and the valve control unit and the pump control unit of the recovery side may be provided individually or in common.

Application Example

Next, as an application example of the ink supply device described above, an ink jet recording apparatus in which the ink supply devices 10 and 100 described above are applied to an ink supply unit of an ink jet head will be described.

Entire Configuration of Ink Jet Recording Apparatus

Figure 21:
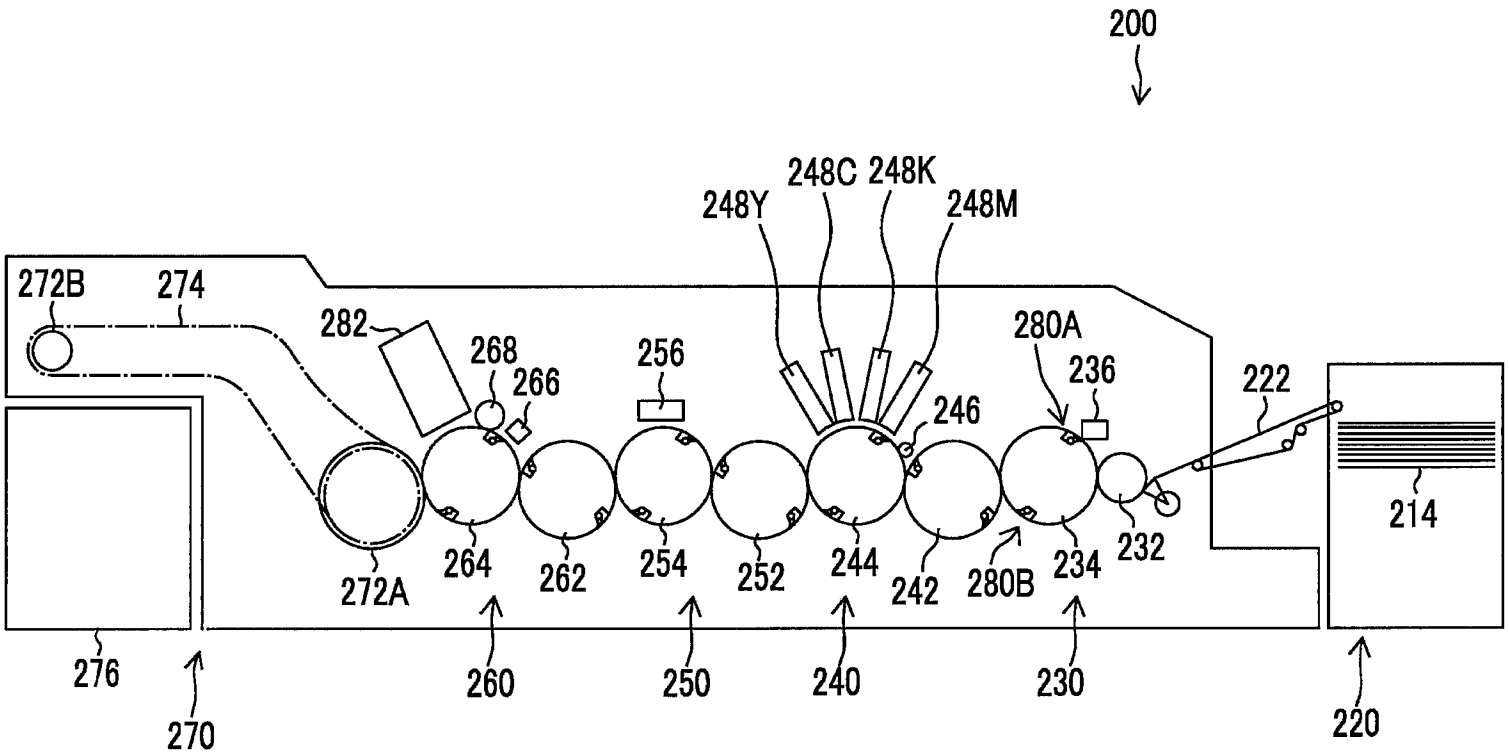
FIG. 21 is an entire configuration diagram illustrating the schematic configuration of an ink jet recording apparatus to which a liquid supply device according to the present invention is applied.

FIG. 21 is a configuration diagram illustrating the entire configuration of the ink jet apparatus including a liquid supply device according to an embodiment of the present invention. The ink jet recording apparatus 200 illustrated in this figure is a recording apparatus of a two-liquid aggregation type in which an image is formed on a recording surface of a recording medium 214 based on predetermined image data using an aggregation treatment liquid that has an ink containing a color material and has a function of aggregating the ink.

The ink jet recording apparatus 200 mainly includes a paper feeding unit 220, a treatment liquid applying unit 230, a drawing unit 240, a drying treatment unit 250, a fixing treatment unit 260, and a discharging unit 270. In addition, although not illustrated in FIG. 21, an ink supply device that supplies ink to the drawing unit 240 is provided.

As means for performing transfer of the recording medium 214 that is transported to the treatment liquid applying unit 230, the drawing unit 240, the drying treatment unit 250, and the front end of the fixing treatment unit 260, transfer cylinders 232, 242, 252, and 262 are provided, and as means for transporting the recording medium 214 to each of the treatment liquid applying unit 230, the drawing unit 240, the drying treatment unit 250, and the fixing treatment unit 260 while holding the recording medium 214, pressing cylinders 234, 244, 254, and 264 having drum shapes are provided.

The transfer cylinders 232 to 262 and the pressing cylinders 234 to 264 are provided with grippers 280A and 280B at predetermined positions on the outer peripheral surfaces to hold the front end portion of the recording medium 214 while being interposed. The structure in which the front end portion of the recording medium 214 is interposed and held by the grippers 280A and 280B and the structure in which transfer of the recording medium 214 is performed between the grippers provided in different pressing cylinders or transfer cylinders are the same. In addition, the grippers 280A and 280B are arranged at symmetrical positions at 180° with respect to the rotation direction of the pressing cylinder 234 on the outer peripheral surface of the pressing cylinder 234.

When the transfer cylinders 232 to 262 and the pressing cylinders 234 to 264 are rotated in a predetermined direction in the state where the front end portion of the recording medium 214 is nipped by the grippers 280A and 280B, the recording medium 214 is rotated and transported along the outer peripheral surface of the transfer cylinders 232 to 262 and the pressing cylinders 234 to 264.

In addition, in FIG. 21, only the grippers 280A and 280B provided in the pressing cylinder 234 are denoted by reference numerals, and reference numerals of the other pressing cylinders and the transfer cylinders are omitted.

When the recording medium (sheet) 214 that is accommodated in the paper feeding unit 220 is fed to the treatment liquid applying unit 230, an aggregation treatment liquid (hereinafter, simply referred to as a "treatment liquid") is applied onto the recording surface of the recording medium 214 held on the outer peripheral surface of the pressing cylinder 234. In addition, the "recording surface of the recording medium 214" is an outside surface in the state where the pressing cylinders 234 and 264 are held and is an opposite surface to the surface held by the pressing cylinders 234 and 264.

Thereafter, the recording medium 214 to which the aggregation treatment liquid is applied is sent to the drawing unit 240, and in the drawing unit 240, color ink is applied to a region of the recording surface to which the aggregation treatment liquid is applied, thereby forming a desired image.

Moreover, the recording medium 214 on which the image is formed by the color ink is sent to the drying treatment unit 250 to be subjected to a drying treatment in the drying treatment unit 250, and after the drying treatment, is sent to the fixing treatment unit 260 to be subjected to a fixing treatment. By performing the drying treatment and the fixing treatment, the image formed on the recording medium 214 is strengthened. In this manner, the desired image is formed on the recording surface of the recording medium 214, and the image is fixed on the recording surface of the recording medium 214 and is thereafter transported to the outside of the apparatus from the discharging unit 270.

Hereinafter, each unit (the paper feeding unit 220, the treatment liquid applying unit 230, the drawing unit 240, the drying treatment unit 250, the fixing treatment unit 260, and the discharging unit 270) of the ink jet recording apparatus 200 will be described in detail.

Paper Feeding Unit

The paper feeding unit 220 is provided with a paper feeding tray 222 and a sending mechanism (not shown) and is configured so that the recording medium 214 is sent from the paper feeding tray 222 one by one. The recording medium 214 sent from the paper feeding tray 222 is subjected to position determination by a guide member (not shown) so that the front end portion thereof is positioned at the position of the gripper (not shown) of the transfer cylinder (paper feeding cylinder) 232 and is temporarily stopped. In addition, the grippers (not shown) interpose and hold the front end portion of the recording medium 214, and the transfer of the recording medium 214 between the grippers provided in the treatment liquid cylinder 234 is performed.

Treatment Liquid Applying Unit

The treatment liquid applying unit 230 includes the treatment liquid cylinder (treatment liquid drum) 234 which holds the recording medium 214 transferred from the paper feeding cylinder 232 on the outer peripheral surface and transports the recording medium 214 in a predetermined transport direction, and the treatment liquid applying unit 230 that applies a treatment liquid onto the recording surface of the recording medium 214 held on the outer peripheral surface of the treatment liquid cylinder 234. When the treatment liquid cylinder 234 is rotated counterclockwise in FIG. 21, the recording medium 214 is transported in the counterclockwise rotation direction along the outer peripheral surface of the treatment liquid cylinder 234.

The treatment liquid applying unit 230 illustrated in FIG. 21 is provided at a position that opposes the outer peripheral surface (recording medium holding surface) of the treatment liquid cylinder 234. As a configuration example of the treatment liquid applying unit 230, there may be a form that includes a treatment liquid container which stores the treatment liquid, a pumping roller of which a part is immersed in the treatment liquid of the treatment liquid container to pumps up the treatment liquid in the treatment liquid container, and an applying roller (rubber roller) that moves the treatment liquid pumped up by the pumping roller onto the recording medium 214.

In addition, a form that is configured to include an applying roller moving mechanism that moves the applying roller in the vertical direction (the normal direction of the outer peripheral surface of the treatment liquid cylinder 234) so as not to apply the treatment liquid to parts other than the recording medium 214 is preferable. In addition, the grippers 280A and 280B that nip the front end portion of the recording medium 214 are arranged so as not to protrude from the peripheral surface.

The treatment liquid applied to the recording medium 214 by the treatment liquid applying unit 230 contains a color material aggregation material that aggregates a color material (pigment) in the ink applied to the drawing unit 240, and when the treatment liquid comes into contact with ink on the recording medium 214, separation between the color material in the ink and a solvent is accelerated.

It is preferable that the treatment liquid applying unit 230 apply the treatment liquid while measuring the amount of the treatment liquid applied to the recording medium 214, and it is preferable that the thickness of the treatment liquid on the recording medium 214 be sufficiently smaller than the diameter of ink droplets propelled from the drawing unit 240.

Drawing Unit

The drawing unit 240 includes the drawing cylinder (drawing drum) 244 that holds and transports the recording medium 214, a sheet pressing roller 246 that causes the recording medium 214 to come into close contact with the drawing cylinder 244, and ink jet heads 248M, 248K, 248C, and 248Y that apply ink onto the recording medium 214. The basic structure of the drawing cylinder 244 is common to the treatment liquid cylinder 234 described in advance.

The sheet pressing roller 246 is a guide member for causing the recording medium 214 to come into close contact with the outer peripheral surface of the drawing cylinder 244, opposes the outer peripheral surface of the drawing cylinder 244, is disposed further on the downstream side in the transport direction of the recording medium 214 than the transfer position of the recording medium 214 between the transfer cylinder 242 and the drawing cylinder 244, and is disposed further on the upstream side in the transport direction of the recording medium 214 than the ink jet heads 248M, 248K, 248C, and 248Y In addition, between the sheet pressing roller 246 and the ink jet head 248Y on the upstream side furthest in the transportation direction of the recording medium 214, a sheet lift detection sensor (not shown) is disposed. The sheet lift detection sensor detects the lift amount immediately before the recording medium 214 enters the space immediately below the ink jet heads 248M, 248K, 248C, and 248Y. The ink jet recording apparatus 200 illustrated in this example is configured so that in a case where the lift amount of the recording medium 214 detected by the sheet lift detection sensor is higher than a predetermined threshold, the intent is informed and the transport of the recording medium 214 is stopped.

The recording medium 214 transferred to the drawing cylinder 244 from the transfer cylinder 242 is pressed by the sheet pressing roller 246 when the recording medium 214 is rotated and transported in the state where the front end thereof is held by the grippers (reference numerals thereof are omitted) and is thus caused to come into close contact with the outer peripheral surface of the drawing cylinder 244. In this manner, after the recording medium 214 is caused to come into close contact with the outer peripheral surface of the drawing cylinder 244, the recording medium 214 is sent to printing regions immediately below the ink jet heads 248M, 248K, 248C, and 248Y in the state where there is no lifting thereof from the outer peripheral surface of the drawing cylinder 244.

The ink jet heads 248M, 248K, 248C, and 248Y respectively correspond to four colors of ink including magenta (M), black (K), cyan (C), and yellow (Y), are arranged in this order from the upstream side in the rotation direction (the counterclockwise rotation direction in FIG. 21) of the drawing cylinder 244, and are arranged so that the ink discharge surfaces (nozzle surfaces) of the ink jet heads 248M, 248K, 248C, and 248Y oppose the recording surface of the recording medium 214 held by the drawing cylinder 244. In addition, the "ink discharge surfaces (nozzle surfaces)" are surfaces of the ink jet heads 248M, 248K, 248C, and 248Y that oppose the recording surface of the recording medium 214 and are surfaces in which nozzles (illustrated by being denoted by reference numeral 308 in FIG. 22) which are described later and through which ink are discharged are formed.

In addition, the ink jet heads 248M, 248K, 248C, and 248Y illustrated in FIG. 21 are arranged to be inclined with respect to the horizontal surface so that the recording surface of the recording medium 214 held on the outer peripheral surface of the drawing cylinder 244 is substantially parallel to the nozzle surfaces of the ink jet heads 248M, 248K, 248C, and 248Y.

The ink jet heads 248M, 248K, 248C, and 248Y are full-line type heads that have lengths corresponding to the maximum width (length in a direction orthogonal to the transport direction of the recording medium 214) of image formation regions of the recording medium 214 and are installed to be fixed so as to extend in the direction orthogonal to the transport direction of the recording medium 214. In addition, ink is supplied to each of the ink jet heads 248M, 248K, 248C, and 248Y from the ink supply device that is described later in detail.

In the nozzle surfaces (liquid discharge surfaces) of the ink jet heads 248M, 248K, 248C, and 248Y, nozzles for ink discharge are formed in a matrix arrangement over the entire width of the image formation region of the recording medium 214.

When the recording medium 214 is transported to the printing region immediately below the ink jet heads 248M, 248K, 248C, and 248Y, the corresponding colors of ink are discharged (propelled) from the ink jet heads 248M, 248K, 248C, and 248Y onto the region of the recording medium 214 to which an aggregation treatment liquid is applied based on image data.

When liquid droplets of the corresponding color inks are discharged from the ink jet heads 248M, 248K, 248C, and 248Y toward the recording surface of the recording medium 214 held on the outer peripheral surface of the drawing cylinder 244, the treatment liquid and ink come into contact with each other on the recording medium 214, and an aggregation reaction of a color material (pigment-based color material) dispersed in the ink or an insoluble color material (dye-based color material) occurs, thereby forming a color material aggregate. Accordingly, the movement (position shift of dots and stains of dots) of the color material in the image formed on the recording medium 214 is prevented.

In addition, the drawing cylinder 244 of the drawing unit 240 is separated from the treatment liquid cylinder 234 of the treatment liquid applying unit 230 in terms of structure. Therefore, the treatment liquid does not adhere to the ink jet heads 248M, 248K, 248C, and 248Y and a factor of an ink discharge error may be reduced.

In addition, in this example, the configuration of standard colors (4 colors) of MKCY is exemplified. However, the combinations of ink colors and the number of colors are not limited to this embodiment, and light ink, thick ink, and special color ink may be added as necessary. For example, a configuration in which an ink jet head that discharges light color-based ink such as light cyan or light magenta is added may be employed, and the arrangement order of color heads is not particularly limited.

Drying Treatment Unit

The drying treatment unit 250 includes the drying cylinder (drying drum) 254 that holds and transports the recording medium 214 after image formation, and a drying treatment device 256 that performs a drying treatment of drying moisture (liquid contents) on the recording medium 214. The basic structure of the drying cylinder 254 is common to the treatment liquid cylinder 234 and the drawing cylinder 244 described above, and thus description thereof will be omitted herein.

The drying treatment device 256 is a treatment unit that is disposed at a position opposing the outer peripheral surface of the drying cylinder 254 to vaporize moisture that is present in the recording medium 214. When ink is applied to the recording medium 214 by the drawing unit 240, a liquid component (solvent component) of the ink separated due to the aggregation reaction of the treatment liquid and the ink and a liquid component (solvent component) of the treatment liquid remains on the recording medium 214. Therefore, the liquid components need to be removed.

The drying treatment apparatus 256 is a treatment unit that performs a drying treatment of drying the liquid components which are present on the recording medium 214 through heating by a heater, blowing by a fan, or both thereof so as to remove the liquid components on the recording medium 214. The heating amount and the blowing amount applied to the recording medium 214 are appropriately set depending on the parameters including the amount of moisture that remains on the recording medium 214, the type of the recording medium 214, the transport speed (drying treatment time) of the recording medium 214, and the like.

When the drying treatment is performed by the drying treatment apparatus 256, since the drying cylinder 254 of the drying treatment unit 250 is separated from the drawing cylinder 244 of the drawing unit 240 in terms of structure, a factor of an ink discharge error due to drying of head meniscus portions by heat or blowing may be reduced in the ink jet heads 248M, 248K, 248C, and 248Y.

In order to exhibit the correction effect of cockling of the recording medium 214, the curvature of the drying cylinder 254 may be higher than or equal to 0.002 (1/mm). In addition, in order to prevent curving (curling) of the recording medium after the drying treatment, the curvature of the drying cylinder 254 may be less than or equal to 0.0033 (1/mm).

In addition, means (for example, a built-in heater) for adjusting the surface temperature of the drying cylinder 254 may be provided to adjust the surface temperature to be higher than or equal to 50° C. Drying is accelerated by performing the heating treatment from the rear surface of the recording medium 214, and thus image destruction during a fixing treatment in a subsequent step is prevented. In this form, it is more effective that means for causing the recording medium 214 to come in close contact with the outer peripheral surface of the drying cylinder 254 be provided. As an example of the means for causing the recording medium 214 to come in close contact, there are vacuum adsorption, electrostatic adsorption, and the like.

In addition, the upper limit of the surface temperature of the drying cylinder 254 is not particularly limited. However, in terms of the stability (prevention of burns due to high temperatures) of a maintenance operation such as cleaning of the ink that adheres to the surface of the drying cylinder 254, it is preferable that the upper limit thereof be set to be less than or equal to 75° C. (more preferably, less than or equal to 60° C.).

As the recording medium 214 is held on the outer peripheral surface of the drying cylinder 254 configured as described above so that the recording surface thereof faces the outside (that is, in a state of being curved so that the recording surface of the recording medium 214 is on the convex side) and is subjected to the drying process while being rotated and transported, drying unevenness caused by wrinkles or lift of the recording medium 214 is reliably prevented.

Fixing Treatment Unit

The fixing treatment unit 260 is configured to include the fixing cylinder (fixing drum) 264 that holds and transports the recording medium 214, a heater 266 that performs a heating treatment on the recording medium 214 on which an image is formed and from which the liquid is removed, and a fixing roller 268 that presses the recording medium 214 from the recording surface side. The basic structure of the fixing cylinder 264 is common to the treatment liquid cylinder 234, the drawing cylinder 244, and the drying cylinder 254, and thus description thereof will be omitted herein. The heater 266 and the fixing roller 268 are arranged at positions opposing the outer peripheral surface of the fixing cylinder 264 and are arranged in this order from the upstream side in the rotation direction (the counterclockwise rotation direction in FIG. 21) of the fixing cylinder 264.

In the fixing treatment unit 260, a preliminary heating treatment is performed on the recording surface of recording medium 214 by the heater 266, and the fixing treatment is performed thereon by the fixing roller 268. The heating temperature of the heater 266 is appropriately set depending on the type of the recording medium, the type of ink (the type of polymer fine particles contained in the ink), and the like. For example, a form in which the heating temperature thereof is a glass transition temperature or a minimum film forming temperature of the polymer fine particles contained in the ink is considered.

The fixing roller 268 is a roller member that heats and pressurizes the dried ink to fuse self-dispersing polymer fine particles in the ink and make the ink as a film, and is configured to heat and pressurize the recording medium 214. Specifically, the fixing roller 268 is disposed to come into pressing contact with the fixing cylinder 264 and configures a nip roller with the fixing cylinder 264. Accordingly, the recording medium 214 is interposed between the fixing roller 268 and the fixing cylinder 264, is nipped at a predetermined nip pressure, and is subjected to the fixing treatment.

As a configuration example of the fixing roller 268, a form configured as a heating roller by assembling a halogen lamp into a metal pipe such as aluminum having good thermal conductivity may be employed. When thermal energy of higher than or equal to the glass transition point of the polymer fine particles contained in the ink is applied through heating the recording medium 214 by the heating roller, the polymer fine particles are fused and a transparent film is formed on the surface of the image.

When pressurization is performed on the recording surface of the recording medium 214 in this state, the polymer fine particles fused on the concaveness and convexity of the recording medium 214 are pressed and fixed, and the concaveness and the convexity of the surface of the image are leveled, thereby obtaining preferable glossiness. In addition, a configuration in which a plurality of stages of fixing rollers 268 according to the thickness of the image layer and the glass transition temperature characteristics of the polymer fine particles is also preferable.

In addition, it is preferable that the surface hardness of the fixing roller 268 be less than or equal to 71°. By further softening the surface of the fixing roller 268, an effect of following the concaveness and the convexity of the recording medium 214 caused by cockling may be expected, and fixing unevenness caused by the concaveness and the convexity of the recording medium 214 is more effectively prevented.

The ink jet recording apparatus 200 illustrated in FIG. 21 is provided with an in-line sensor 282 at a rear stage of the processing region of the fixing treatment unit 260 (on the downstream side in the transport direction of the recording medium). The in-line sensor 282 is a sensor for reading the image (or a check pattern formed on the margin region of the recording medium 214) formed on the recording medium 214, and a CCD line sensor is appropriately used.

The ink jet recording apparatus 200 illustrated in this example determines the presence or absence of a discharge error of the ink jet heads 248M, 248K, 248C, and 248Y based on the read result of the in-line sensor 282. In addition, a form in which the in-line sensor 282 includes measuring means for measuring moisture amounts, surface temperatures, glossiness, and the like is possible. In this form, parameters such as the treatment temperature of the drying treatment unit 250, the heating temperature and the pressurization pressure of the fixing treatment unit 260, and the like are appropriately adjusted based on the read result of the moisture amounts, surface temperatures, and glossiness, and the control parameters are appropriately adjusted according to temperature changes in the inside of the apparatus and temperature changes in each unit.

Discharge Unit

As illustrated in FIG. 21, the discharging unit 270 is provided subsequent to the fixing treatment unit 260. The discharging unit 270 is configured to include an endless transport chain 274 wound around tension rollers 272A and 272B, and a discharge tray 276 in which the recording medium 214 after the image formation is accommodated.

The recording medium 214 after being subjected to the fixing treatment, which is sent from the fixing treatment unit 260 is transported by the transport chain 274 and is discharged to the discharge tray 276.

Structure of Ink Jet Head

Next, an example of the structures of the ink jet heads 248M, 248K, 248C, and 248Y included in the drawing unit 240 will be described. In addition, since the structures of the ink jet heads 248M, 248K, 248C, and 248Y corresponding to the respective colors are common, hereinafter, an ink jet head (hereinafter, also simply referred to as a "head") is denoted by reference numeral 300 for illustration as a representative thereof.

Figure 22:
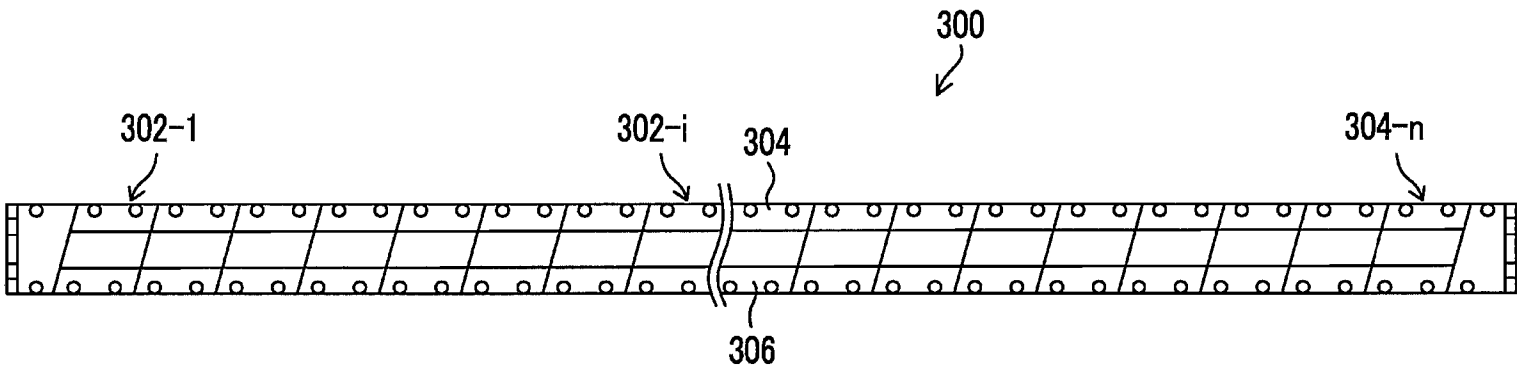
FIG. 22 is a plan perspective view illustrating a configuration example of an ink jet head mounted in the ink jet recording apparatus illustrated in FIG. 21.

FIG. 22 is a schematic configuration diagram of the ink jet head 300. This figure is a diagram (a plan perspective view of the head) viewed from the ink jet head 300 toward the recording surface of the recording medium. The head 300 illustrated in this figure configures a multi-head in which n head modules 302-*i* (i is an integer from 1 to n) are connected to one another in a row along the longitudinal direction of the head 300. Each head module 302-*i* is supported by head covers 304 and 306 from both sides in the lateral direction of the head 300. In addition, it is possible to configure a multi-head by arranging the head modules 302 in a zigzag form.

As an application example of the multi-head constituted by a plurality of sub-heads, there is a full-line type head corresponding to the entire width of the recording medium. The full-line type head has a structure in which a plurality of nozzles (illustrated by being denoted by reference numeral 308 in FIG. 23) are lined up in a direction (main-scanning direction) orthogonal to the movement direction (sub-scanning direction) of the recording medium to correspond to the length (width) in the main-scanning direction of the recording medium. In a so-called single-pass image recording method in which image recording is performed by scanning the head 300 having the above configuration and the recording medium relative to each other only once, an image may be formed over the entire surface of the recording medium.

The head modules 302-*i* that constitute the head 300 have a substantially parallelogram plane shape, and an overlap portion is provided between adjacent sub-heads. The overlap portions are connection parts of the sub-heads and are formed by nozzles of which adjacent dots belong to different sub-heads with respect to the lined-up direction of the head modules 302-*i*. In addition, the head 300 illustrated in FIG. 22 is equivalent to the head 50' illustrated in FIG. 9, and the head module 302 is equivalent to the head module 51.

Figure 23:
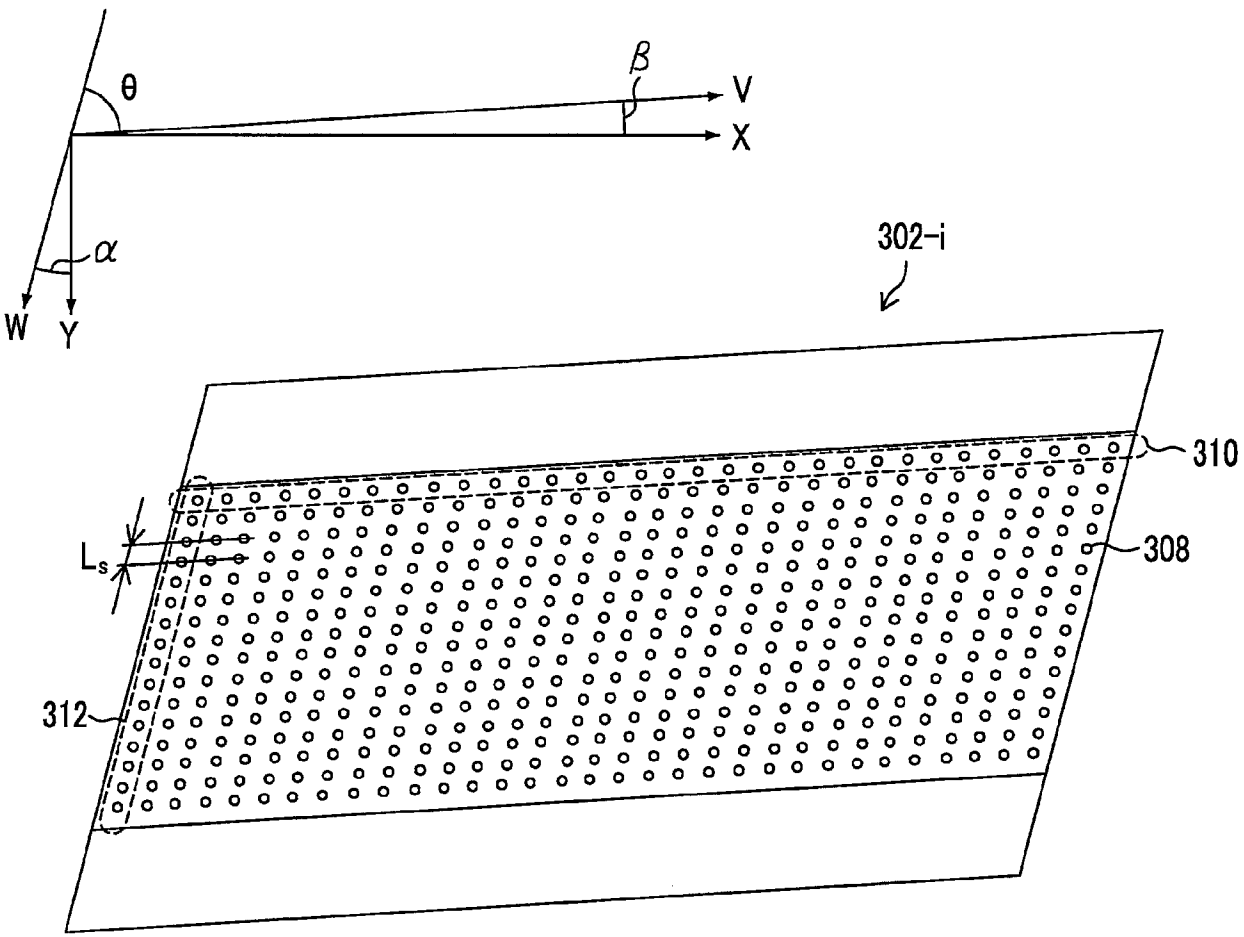
FIG. 23 is a plan view illustrating the nozzle arrangement of the ink jet head illustrated in FIG. 22.

FIG. 23 is a plan view illustrating the nozzle arrangement of the head modules 302-*i*. As illustrated in this figure, each head module 302-*i* has a structure in which the nozzles 308 are two-dimensionally lined-up, and the head including the head modules 302-*i* is a so-called matrix head. The head module 302-*i* illustrated in FIG. 23 has a structure in which a number of nozzles 308 are lined up along a column direction W at an angle of $\alpha$ with respect to the sub-scanning direction Y and along a row direction V at an angle of $\beta$ with respect to the main-scanning direction X, and the practical nozzle arrangement density in the main-scanning direction X is increased. In FIG. 23, a nozzle group (nozzle row) lined up along the row direction V is illustrated by being denoted by reference numeral 310, and a nozzle group (nozzle column) lined up along the column direction W is illustrated by being denoted by reference numeral 312.

In addition, as another example of the matrix arrangement of the nozzles 308, there is a configuration in which a plurality of nozzles 308 are arranged in the row direction along the main-scanning direction X and in the column direction which is a direction inclined with respect to the main-scanning direction X.

Figure 24:
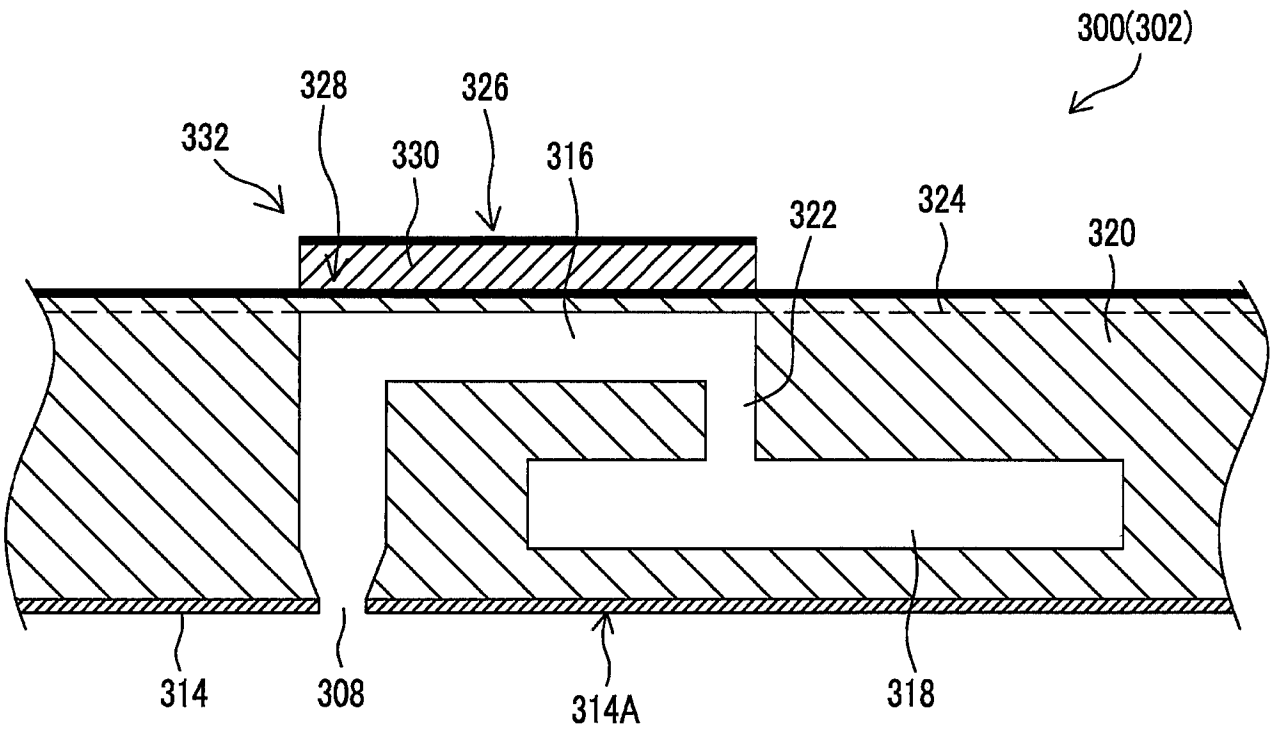
FIG. 24 is a cross-sectional view illustrating the three-dimensional structure of the ink jet head illustrated in FIG. 22.

FIG. 24 is a cross-sectional view illustrating the three-dimensional structure of a liquid droplet discharge element (an ink chamber unit corresponding to a single nozzle 308) of one channel which is a recording element unit. As illustrated in this figure, the head 300 (head module 302) in this example has a structure in which a nozzle plate 314 in which the nozzles 308 are formed, a passage plate 320 in which passages such as a pressure chamber 316 and a common passage 318 are formed, and the like are laminated and bonded. The nozzle plate 314 configures a nozzle surface 314A of the head 300 and a plurality of nozzles 308 that respectively communicates with the corresponding pressure chambers 316 are two-dimensionally formed.

The passage plate 320 is a passage formation member that configures the side wall portion of the pressure chamber 316 and forms a supply port 322 as a narrowed portion (narrowest portion) of an individual supply passage which guides ink from the common passage 318 to the pressure chamber 316. For convenience of description, although simply illustrated in FIG. 24, the passage plate 320 has a structure in which a single or a plurality of substrates are laminated.

The nozzle plate 314 and the passage plate 320 may be processed into shapes needed for a semiconductor manufacturing process using silicon as a material.

The common passage 318 communicates with an ink tank (not shown) which is an ink supply source, and the ink supplied from the ink tank is supplied to each pressure chamber 316 via the common passage 318.

To a vibration plate 324 that configures a partial surface (top surface in FIG. 24) of the pressure chamber 316, a piezoelectric actuator 332 which includes an individual electrode 326 and a lower electrode 328 and has a structure in which a piezoelectric element 330 is interposed between the individual electrode 326 and the lower electrode 328 is bonded. When the vibration plate 324 is configured with a metal thin film or a metal oxide film, the vibration plate 324 functions as a common electrode corresponding to the lower electrode 328 of the piezoelectric actuator 332. In addition, in a form in which the vibration plate is formed of a non-conductive material such as a resin, the lower electrode layer is formed on the surface of the vibration plate of a conductive material such as a metal.

The piezoelectric actuator 332 is deformed by applying a driving voltage to the individual electrode 326 and thus the volume of the pressure chamber 316 is changed, and due to the pressure change caused by this, ink is discharged from the nozzles 308. After ink discharge, when the piezoelectric actuator 332 is returned to its original state, the pressure chamber 316 is re-filled with new ink through the supply port 332 from the common passage 318.

As illustrated in FIG. 23, a number of the ink chamber units having the above structure are arranged in a lattice form having a predetermined arrangement pattern along the row direction V at an angle of $\beta$ with respect to the main-scanning direction X and along the column direction W at an angle of $\alpha$ with respect to the sub-scanning direction Y, thereby realizing the high-density nozzle head in this example. In this matrix arrangement, when it is assumed that the interval of adjacent nozzles in the sub-scanning direction Y is Ls, in the main-scanning direction X, the nozzles 308 are considered as being equivalent to the arrangement in a linear form at a constant pitch of $P=Ls/\tan\theta$.

In this example, as means for generating the discharge force of the ink discharged from the nozzles 308 provided in the head 300, the piezoelectric actuator 322 is applied. However, it is possible to apply a thermal method in which a heater is provided in the pressure chamber 316 and ink is discharged using a film boiling pressure due to heating by the heater.

Description of Control System

Figure 25:
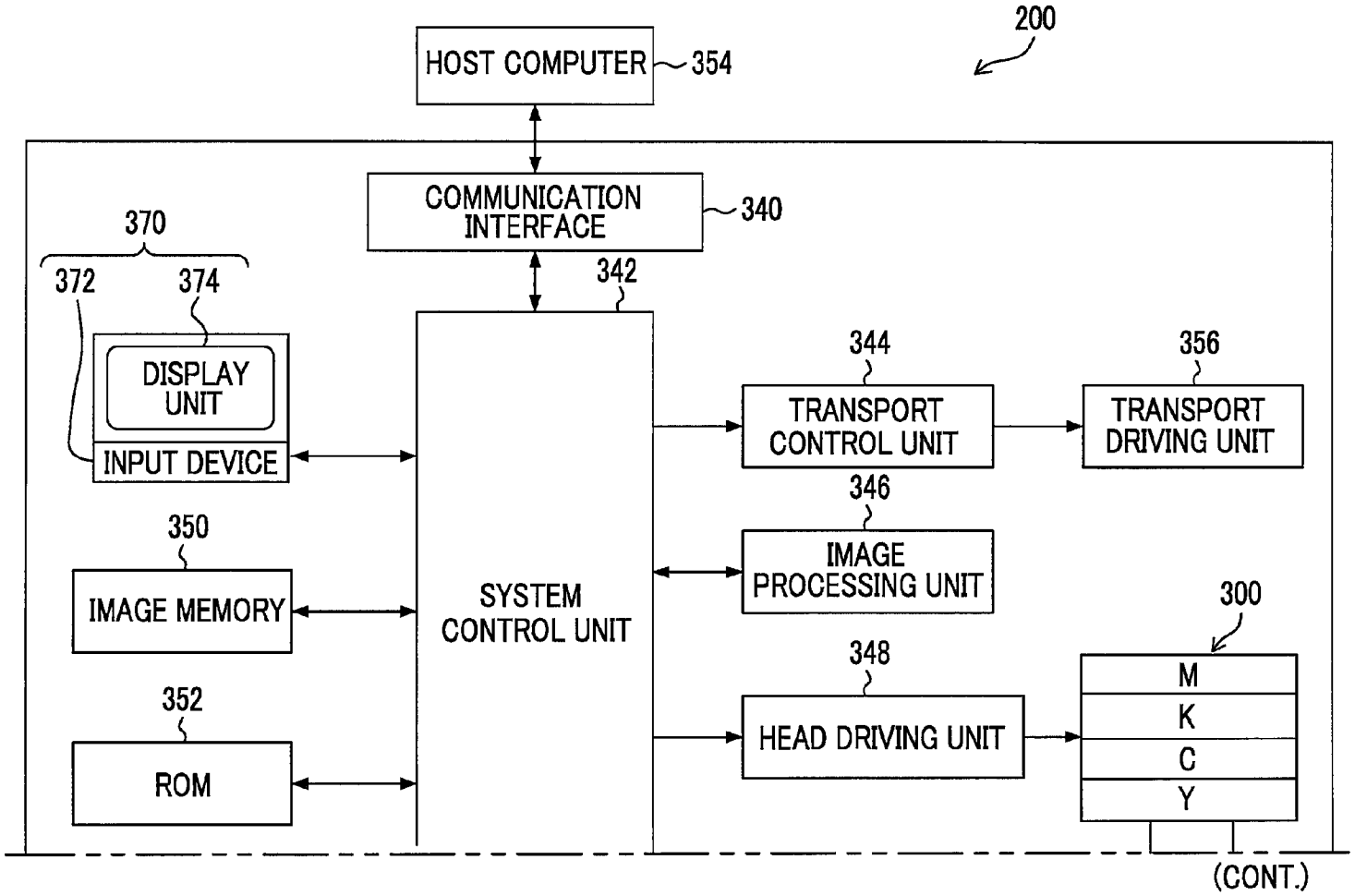
FIG. 25 is a block diagram of main units for illustrating the configuration of a control unit applied to the ink jet recording apparatus illustrated in FIG. 21.

FIG. 25 is a block diagram illustrating the schematic configuration of the control system of the ink jet recording apparatus 200. The ink jet recording apparatus 200 includes a communication interface 340, a system control unit 342, a transport control unit 344, an image processing unit 346, and a head driving unit 348, and includes an image memory 350 and a ROM 352.

The communication interface 340 is an interface unit that receives image data sent from a host computer 354. As the communication interface 340, a serial interface such as a USB (Universal Serial Bus) may be applied, or a parallel interface such as Centronics may be applied. The communication interface 340 may include a buffer memory (not shown) mounted for increasing the speed of communication.

The system control unit 342 is configured with a central processing unit (CPU), peripheral circuits thereof, and the like, functions as a control device that controls the entire ink jet recording apparatus 200 according to predetermined programs, functions as an operation device that performs various operations, and moreover, functions as a memory controller for the image memory 350 and the ROM 352. That is, the system control unit 342 controls each unit of the communication interface 340, the transport control unit 344, and the like, performs control of communication with the host computer 354 and control of reading and writing of the image memory 350 and the ROM 352, and generates a control signal for controlling each of the units described above.

The image data sent from the host computer 354 is input to the ink jet recording apparatus 200 via the communication interface 340, and a predetermined image process is performed by the image processing unit 346.

The image processing unit 346 is a control unit that has a signal (image) processing function of performing various processing and correction processes and the like to generate a signal for printing control from the image data and supplies the generated printing data to the head driving unit 348. Signal processing needed for the image processing unit 346 is performed, and based on the image data, control of the amount of discharge liquid droplets (amount of propelled droplets) or discharge timing of the head 300 is performed by the head driving unit 348. Accordingly, desired dot sizes and dot arrangements are realized. In addition, the head driving unit 348 illustrated in FIG. 25 may include a feedback control system for maintaining constant driving conditions of the head 300.

The transport control unit 344 controls the transport timing and the transport speed of the recording medium 214 (see FIG. 21) based on the signal for printing control generated by the image processing unit 346. The transport driving unit 356 illustrated in FIG. 25 includes motors that rotate the pressing cylinders 234 to 264 of FIG. 21, motors that rotate the transfer cylinders 232 to 262, a motor of the sending mechanism of the recording medium 214 in the paper feeding unit 220, a motor that drives the tension roller 272A (272B) of the discharging unit 270, and the like, and the transport control unit 344 functions as a driver of the motors.

The image memory (primary storage memory) 350 has a function as primary storing means for temporarily storing the image data input via the communication interface 340 and a function as a development region of various programs stored in the ROM 352 or a computational operation region (for example, an operation region of the image processing unit 346). As the image memory 350, a sequentially readable and writable volatile memory (RAM) is used.

The ROM 352 stores programs executed by the CPU of the system control unit 342, various data needed for control of each unit of the apparatus, control parameters, and the like, and reading and writing of data are performed by the system control unit 342. The ROM 352 is not limited to a memory made of semiconductor elements and may use a magnetic medium such as a hard disk. In addition, an external interface may be provided to use a detachable storage medium.

Moreover, the ink jet recording apparatus 200 includes a treatment liquid application control unit 360, a drying treatment control unit 362, and a fixing treatment control unit 364, and controls operations of each unit of the treatment liquid applying unit 230, the drying treatment unit 250, and the fixing treatment unit 260 according to the instructions from the system control unit 342

The treatment liquid application control unit 360 controls control of the timing of treatment liquid application based on the printing data obtained from the image processing unit 346 and controls the application amount of the treatment liquid. In addition, the drying treatment control unit 362 controls the timing of the drying treatment performed by the drying treatment device 256, controls the treatment temperature, the blowing amount, and the like. The fixing treatment control unit 364 controls the temperature of the heater 266 and controls the pressing of the fixing roller 268.

An in-line detection unit 466 that includes the in-line sensor 282 illustrated in FIG. 21 is a processing block that includes the signal processing unit which performs predetermined signal processing such as nozzle removal or application, waveform shaping, and the like on the read signal output from the in-line sensor 282. The system control unit 342 determines presence or absence of a discharge error of the head 300 based on the detection signal obtained by the in-line detection unit.

An ink supply control unit 386 performs control of the supply of ink to the head 300 by the ink supply unit 388. As a specific example of the ink supply control unit 386, the configuration illustrated in FIG. 9 may be employed. In addition, as the ink supply unit 388 illustrated in FIG. 25, the ink supply devices 10 and 100 described above are applied.

The ink jet recording apparatus 200 illustrated in this example includes a user interface 370, and the user interface 370 is configured to include an input device 372 for receiving various inputs from an operator (user) and a display unit (display) 374. As the input device 372, various forms such as a keyboard, a mouse, a touch panel, buttons, and the like may be employed. The operator may perform inputting of printing conditions, selection of an image quality mode, inputting and editing of attached information, search of information, and the like by operating the input device 372, and various types of information such as input contents or search results may be checked through display of the display unit 374. The display unit 374 also functions as means for displaying a warning such as an error message. In addition, the display unit 374 of FIG. 25 may be applied to a display as informing means in the control system illustrated in FIG. 9.

A degassing control unit 378 controls operations of the degassing module 160 that performs the degassing treatment on the liquid sent to the head 300 from the ink tank 52 (see FIG. 1).

A parameter storage unit 380 stores various control parameters needed for the operations of the ink jet recording apparatus 200. The system control unit 342 appropriately read the parameters needed for control and executes updating (rewriting) of the various parameters as necessary.

A pressure sensor 381 (equivalent to the pressure sensors 16 and 116 illustrated in FIG. 17) includes a pressure detection element for measuring the pressure of the ink passage and converts the measured pressure information into an electrical signal to be provided to the system control unit 342. The system control unit 342 transmits command signals to the ink supply control unit 386 so as to correct the operation (rotation speed) of the pump included in the ink supply unit 388 based on the corresponding input information.

A program storage unit 384 is storage means for storing control programs for operating the ink jet recording apparatus 200. The control programs include control programs for the supply pump 20 included in the ink supply unit 388, the recovery pump 120, the degassing module 160, the heat exchanger 166, and the like.

Application Example to Configuration of Another Apparatus

In this modified example, as an example of an image forming apparatus, the ink jet recording apparatus has been described. However, the application range of the present invention is not limited to applications of so-called graphic printing such as photograph printing or poster printing, and apparatuses for industrial purposes capable of forming patterns that are perceived as an image, such as a resist printing apparatus, a wiring drawing apparatus of an electronic circuit board, and a fine structure forming apparatus may also be included.

The technical scope of the present invention is not limited to the scope described in the embodiments. The configurations and the like in the embodiments may be appropriately combined between the embodiments without departing from the spirit of the present invention.

What is clamed is:

1. A liquid supply device comprising:

a liquid supply passage which communicates with a recording head;

a liquid pressure applying part provided in the liquid supply passage that applies a pressure to liquid;

a pressure buffering unit provided en route in the liquid supply passage and being configured to include a liquid chamber having a supply port and a discharge port through which the liquid flowing through the liquid supply passage flows in and out, a gas chamber provided to oppose the liquid chamber, and a flexible membrane interposed between the liquid chamber and the gas chamber;

a pressure detecting part that detects a pressure in the liquid chamber; and a control part that controls driving of the liquid pressure applying part based on a detection result of the pressure detecting part, thereby applying a predetermined back pressure to a nozzle arranged in the recording head, wherein the flexible membrane is provided with initial bending in advance.

2. The liquid supply device according to claim 1, wherein the flexible membrane has a three-dimensional shape that follows a shape of an inner wall of the gas chamber.

3. The liquid supply device according to claim 2, further comprising an air communication passage switching part that switches between opening and blocking of the gas chamber to and from an air, wherein the initial bending is provided by changing a bending amount of the flexible membrane by the liquid pressure applying part in a state where the gas chamber is open to the air and by blocking the gas chamber from the air when the bending amount becomes a desired bending amount.

4. The liquid supply device according to claim 1, wherein the inner wall of the gas chamber has a curved surface.

5. A liquid discharge device comprising:

the liquid supply device according to claim 1;

a recording head which discharges liquid from a nozzle; and a liquid storage unit which communicates with the liquid supply passage and stores the liquid discharged from the nozzle.

6. An image recording apparatus comprising:

the liquid discharge device according to claim 5; and a scanning part that relatively moves the recording head and a recording medium with each other.

7. A liquid supply device comprising:

a liquid supply passage which communicates with a recording head;

a first liquid pressure applying part provided in the liquid supply passage that applies a pressure to liquid;

a first pressure buffering unit provided en route in the liquid supply passage and being configured to include a first liquid chamber having a supply port and a discharge port through which the liquid flowing through the liquid supply passage flows in and out, a first gas chamber provided to oppose the first liquid chamber, and a first flexible membrane interposed between the first liquid chamber and the first gas chamber;

a liquid recovery passage which communicates with the recording head;

a second liquid pressure applying part provided in the liquid recovery passage that applies a pressure to the liquid; and a second pressure buffering unit provided en route in the liquid recovery passage and being configured to include a second liquid chamber having a supply port and a discharge port through which the liquid flowing through the liquid recovery passage flows in and out, a second gas chamber provided to oppose the second liquid chamber, and a second flexible membrane interposed between the second liquid chamber and the second gas chamber, wherein the first flexible membrane and the second flexible membrane are provided with initial bending in advance.

8. The liquid supply device according to claim 7, wherein the first flexible membrane and the second flexible membrane have three-dimensional shapes that follow shapes of inner walls of the first gas chamber and the second gas chamber, respectively.

9. The liquid supply device according to claim 8, further comprising:

a first air communication passage switching part that switches between opening and blocking of the first gas chamber to and from an air; and a second air communication passage switching part that switches between opening and blocking of the second gas chamber to and from an air, wherein the initial bending is provided to the first membrane by changing a bending amount of the first flexible membrane by the first liquid pressure applying part in a state where the first gas chamber is open to the air and by blocking the first gas chamber from the air when the bending amount becomes a desired bending amount, and the initial bending is provided to the second flexible membrane by changing a bending amount of the second flexible membrane by the second liquid pressure applying part in a state where the second gas chamber is open to the air, and by blocking the second gas chamber from the air when the bending amount becomes a desired bending amount.

10. The liquid supply device according to claim 7, wherein the inner wall of the first gas chamber and the inner wall of the second gas chamber have curved surfaces.

11. The liquid supply device according to claim 7, further comprising:

a first pressure detecting part that detects a pressure in the first liquid chamber;

a second pressure detecting part that detects a pressure in the second liquid chamber; and a control part that controls driving of the first liquid pressure applying part and the second liquid pressure applying part based on detection results of the first pressure detecting part and the second pressure detecting part, thereby providing a predetermined pressure difference between the pressure in the first liquid chamber and the pressure in the second liquid chamber and applying a predetermined back pressure to a nozzle arranged in the recording head.

* * * * *